US011719133B1

(12) United States Patent
Teague et al.

(10) Patent No.: US 11,719,133 B1
(45) Date of Patent: Aug. 8, 2023

(54) ACCUMULATING AND STORING ENERGY IN SEPARATED MIXED REFRIGERANTS FOR CONVERSION TO ELECTRICAL OR MECHANICAL POWER

(71) Applicant: Solutiatech LLC, Coppell, TX (US)

(72) Inventors: Ken Teague, Coppell, TX (US); Powell Cutts, Houston, TX (US)

(73) Assignee: SOLUTIATECH LLC, Coppell, TX (US)

( * ) Notice: Subject to any disclaimer, the term of this patent is extended or adjusted under 35 U.S.C. 154(b) by 0 days.

(21) Appl. No.: 17/971,397

(22) Filed: Oct. 21, 2022

Related U.S. Application Data

(60) Provisional application No. 63/394,197, filed on Aug. 1, 2022.

(51) Int. Cl.
*F01K 7/16* (2006.01)
*F01K 13/02* (2006.01)

(52) U.S. Cl.
CPC ..... *F01K 7/16* (2013.01); *F01K 13/02* (2013.01); *F25B 2400/141* (2013.01); *F25B 2400/23* (2013.01)

(58) Field of Classification Search
CPC ..... F01K 7/16; F01K 13/02; F25B 2400/141; F25B 2400/23
See application file for complete search history.

(56) References Cited

U.S. PATENT DOCUMENTS

2011/0265476 A1* 11/2011 Berger ..... F01K 13/02 60/671
2015/0013338 A1* 1/2015 Smague ..... F01K 1/16 60/659
2017/0016356 A1* 1/2017 Seo ..... F01K 23/101
2018/0142578 A1* 5/2018 Bucher ..... F01K 13/02

* cited by examiner

*Primary Examiner* — Shafiq Mian
(74) *Attorney, Agent, or Firm* — The Culbertson Group, P.C.; Nathan H. Calvert

(57) ABSTRACT

An ALBERT Process (Accumulation of Latent BTU's & Electricity for Retention & Transfer) is described in various forms, and systems are described for performing the process. In various embodiments, a system and method are provided for storing a liquid mixed refrigerant (MR) separated and stored as Low boiling point (LBP) and high boiling point (HBP) components. These storage components are later used in conjunction with heating and/or cooling sources in effecting the operation of a Rankine cycle to generate electric or mechanical power on a dispatch or when needed basis. The MR is reconstituted by combining the LBP and HBP. In a cycle, the LBP and HBP are later separated from the MR utilizing sporadically available energy sources (for example, solar, wind, hydro, etc.) or consistently available sources (for example geothermal).

20 Claims, 27 Drawing Sheets

ACCUMULATING AND STORING ENERGY IN SEPARATED MIXED REFRIGERANTS FOR CONVERSION TO ELECTRICAL OR MECHANICAL POWER

CROSS-REFERENCE TO RELATED APPLICATIONS

This application claims the benefit, under 35 U.S.C. § 119(e), of U.S. Provisional Patent Application No. 63/394,197 filed Aug. 1, 2022, and entitled "Accumulating And Storing Energy In Separated Mixed Refrigerants For Conversion To Electrical Or Mechanical Power". The entire content of each of this application is incorporated herein by this reference.

BACKGROUND

A Rankine cycle is often used to generate electrical or mechanical power from a heat source such as waste heat. Heat energy is supplied to a boiler where a working fluid such as water is converted to a high pressure gaseous state. The high pressure gas is fed to a turbine to generate electricity or turn a shaft for mechanical power. After passing through turbine the fluid is allowed to condense back into a liquid state before being returned to boiler, completing the cycle.

Variations of the Rankine have been developed to improve its efficiency and suitability for use with lower grade heat sources. For example, the Kalina Cycle process uses a binary working fluid of ammonia and water and operates with various concentrations throughout the system. The lower boiling point of ammonia allows the use of waste heat streams in various applications. A rich mixture of water and ammonia is boiled and superheated, and the superheated vapour is expanded through a turbine. The turbine exhaust is cooled and diluted with the bottoms from a vapour separator and is then fully condensed, restoring the working fluid to the original concentration to be run through the cycle again. Since the ratio of the two components can be varied in different parts of the system to boil at various temperatures, the overall effect is to increase the thermodynamic efficiency by recovering heat at various parts of the process.

While Rankine cycles and their variations are able to employ waste heat to generate power, they generally are run in a continuous cycle are not used to store energy. Furthermore, they tend to suffer from inefficiency, and are typically designed for a particular configuration of heat sources, without adaptability to use different heat sources as energy inputs.

SUMMARY

An ALBERT Process (Accumulation of Latent BTU's & Electricity for Retention & Transfer) is described in various forms, and systems are described for performing the process. In various embodiments, a system and method are provided for storing a liquid mixed refrigerant (MR) separated and stored as Low boiling point (LBP) and high boiling point (HBP) components. These storage components are later used in conjunction with heating and/or cooling sources in effecting the operation of a Rankine cycle to generate electric or mechanical power on a dispatch or when needed basis. The MR is reconstituted by combining the LBP and HBP. In a cycle, the LBP and HBP are later separated from the MR utilizing sporadically available energy sources (for example, solar, wind, hydro, etc.) or consistently available sources (for example geothermal).

According to one aspect of the invention, a method provides flexibly controlled production of mechanical or electrical power using a mixed refrigerant (MR). The method includes splitting the MR into two components and independently storing a low-boiling point fluid (LBP) and a high-boiling point fluid (HBP). An initial heating source is used to vaporize the LBP to a gas state. The LBP in the gas state is fed to a let-down turbine to generate mechanical or electrical power. The method includes adjustably dosing the HBP to condense the LBP gas upon exit from the let-down turbine to a liquid or a two phase liquid and vapor state MR, and storing the MR in a liquid state on which the splitting is again performed.

According to another aspect of the invention, a system is provided for storing energy from one or more energy sources and extracting the stored energy. The system includes an MR storage vessel, a LBP storage vessel, and an HBP storage vessel. A pump coupled to an output of the LBP storage vessel for increasing pressure of a stored LBP. A first heat exchanger is coupled to the pump output for adding heat energy to the LBP. A let-down turbine is coupled to an output of the heat exchanger for extracting energy from the LBP. A dosing valve is coupled to an outlet of the let-down turbine for controlling condensation of the LBP by controlled injection of HBP to form MR stored in the MR storage vessel. A second heat exchanger is coupled to a MR storage vessel output for adding energy to the MR from an external energy source. A separator having an input coupled to an output of the MR storage vessel and two outputs coupled to the LBP storage vessel and the HBP storage vessel, respectively, for separating the MR into LBP and HBP.

DESCRIPTION OF EXAMPLE EMBODIMENTS

In an MR system as described herein, an LBP is employed to generate power at low temperatures when compared against the temperature required if the MR were used in a power cycle. For example, such a low-temperature source could be 0 degrees C. or, depending on the MR used, temperatures as low as −150 degrees C. The HBP absorbs the LBP vapor discharged from the Rankine cycle expansion turbine. By managed HBP dosing of the LBP before and/or after the turbine, the power generation efficiently employs heat source temperatures which may change due to weather, seasons, operations of facilities, or excess sources of heating. After managed dosing, the resulting MR, due to the heat of absorption of the HBP absorbing the LBP, may be used to further heat the LBP before it enters any heating step or before it enters the expansion turbine. After the expansion turbine the MR is then stored separation into the LBP and HBP components.

As an example, a modified ammonia-water power cycle may be used. Generally, ammonia-water power cycles have been used (usually with a waste heat source) to generate electric power. In the modified cycle of this example embodiment, liquid ammonia (NH3), separated from the water, provides a dense storage of energy due to its physical properties of heat of vaporization and vapor pressure. Liquid NH3, pumped to a pressure which allows a heating source to vaporize the NH3, fully or partially, can then be further heated utilized the heat of absorption captured and transfer to the vaporized NH3, which heated NH3 is then used in an ammonia Rankine cycle to generated electric power. After the pressure let-down turbine, water is injected into the NH3 providing for the absorption of the NH3 to the liquid phase. Storing the aqueous ammonia solution and later separating the NH3 from the water provides a unique way to optimize and store energy and/or to allow for better economic performance of generating power. While an ammonia-water cycle is described as an example, many other MR combinations may be used with the processes and systems herein. For example, other suitable mixtures include but are not limited to propane-CO2, propane-pentane, butane-pentane and ethane-pentane.

When incorporated in a power grid, this system and process provide a way to stabilize the grid in a way that competes with other energy storage systems in terms of economic efficiency of the storage. The Rankine cycle can be operated with low-temperature heat sources or may be combined with alternative, standby fuels to obtain higher efficiency energy recovery or to provide high peaking performance. The MR separation process allows unique flexibility and can provide dispatch power demand. The MR separation process may be operated separately from the Rankine cycle, allowing efficient use of available power supplies.

Figure 1:
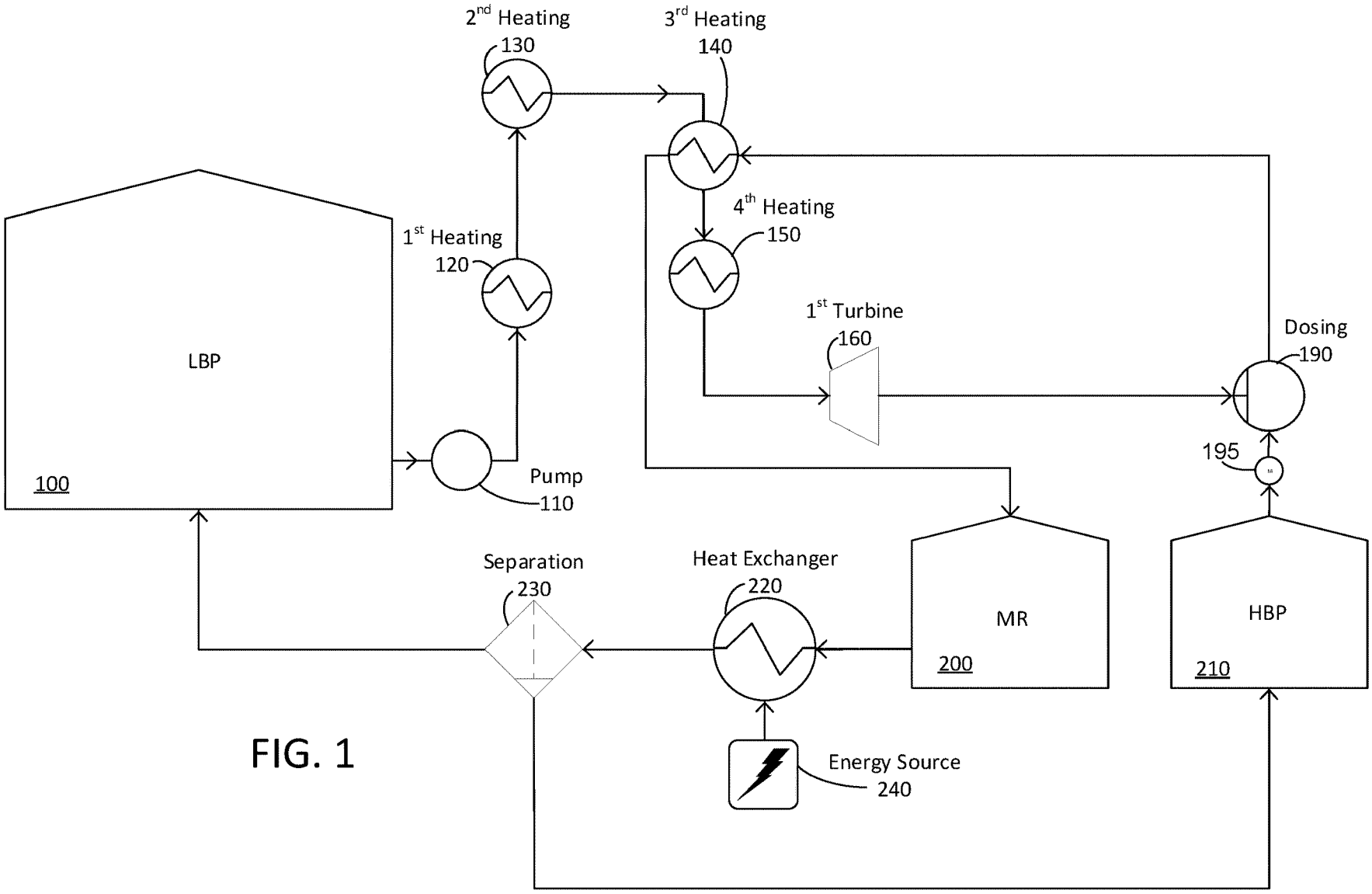
FIG. 1 is a process flow diagram and schematic illustrating a modified Rankine cycle with a LBP and HBP refrigerant process utilizing storage for all working fluids with heating from four different optional sources.

FIG. 1 is a combined process flow diagram and system schematic illustrating a modified Rankine cycle with a LBP and HBP refrigerant process utilizing storage for all working fluids with heating from four different sources. The illustrated system is generally for storing from one or more energy sources and extracting the stored energy.

In this embodiment, the system includes a LBP storage vessel 100 with a pump 110 connected to an output of the LBP storage vessel for increasing pressure of the stored LBP. Four different heat exchangers are shown between pump 110 and a first turbine 160 which extracts stored energy from the LBP. The depicted design may be modified in various implementations for different combinations heat sources depending upon the number and quality of any such heat sources. The heat sources may be alone or in any number of heat sources. A first heat exchanger 120 is connected to output of pump 110 for adding heat energy to the LBP from an external refrigeration system to cool a heat-generating component of the refrigeration system such as a condenser coil. In this example, a second heat exchanger 130 is connected to the output of first heat exchanger 120 for providing heat from an external waste heat recovery system or from atmospheric air. A third heat exchanger 140 is connected to the output of second heat exchanger 130 to absorb heat from an HBP dosing step as further described below. A fourth heat exchanger 150 is connected to the output of third heat exchanger 140 for adding heat based on an additional heating source such as a super heater or supplemental heater utilizing for example, solar heating, propane fueled heater, heat from an electric heater, or heat from a turbine exhaust.

An expansion turbine or pressure let-down turbine ("turbine 160") is connected to the output of fourth heat exchanger 150 output for extracting energy from the LBP. Turbine 160 may be connected to a generator for producing electrical power or a shaft or other means to extract mechanical power. A dosing injection port 190 is connected to the turbine output at an injection port for controlling partial condensation of the LBP by controlled injection of HBP from an HBP storage vessel 210 to form a MR. A dosing control valve 195 feeds dosing injection port 190 with HBP from vessel 210. Dosing rates are controlled by monitoring LBP mass in the vapor and within the HBP being injected to obtained the preferred temperature of the MR being formed, which temperature allows for either the highest obtainable cycle efficiencies or allows the cycle to generate the highest amount of power. The combined output of the HBP dosing and the expanded LBP from the turbine output are passed through third heat exchanger 140 and fed to a MR storage vessel 200.

A heat exchanger 220 is connected to the output of MR storage vessel 200 for adding energy to the MR from an external energy source 240. A resistive heater or other electrically powered heater may be included for converting electrical energy to heat energy at heat exchanger 220. External energy source 240 may be any suitable energy source from which energy is desired to be stored. For example, an electrical power gird or power system supplied by solar generation or wind generation may power a heater at heat exchanger 220. A thermal solar heating source or other source of heat energy may also be used for energy source 240.

A separator 230 has an input coupled to an output of the MR storage vessel through heat exchanger 220, and two outputs, one connected to LBP storage vessel 100 and one connected to HBP storage vessel 210, for separating the MR into LBP and HBP.

In operation, the process is separated in two storage phases: the LBP/HBP separated phase (100 & 210) and the MR stored phase (200).

As a beginning point, the LBP refrigerant ("LBP"), stored in either atmospheric tanks, pressure vessels or in a combination of the two at LBP vessel 100, is pumped to pressure by pump 110 which allows for use of available heating source (at 120, 130, 140, 150) or other heat sources such as vaporization heating at dosing valves 190 and heat exchanger 170 (FIG. 9) to vaporize or partially vaporize the LBP at the pumped pressure. The higher the temperature of the vaporization heating source the higher the pumped pressure will be and therefore the greater thermal efficiency of the system.

Because the LBP may be stored at low temperatures and low pressures, initial heating may be used for refrigeration demands at first heat exchanger 120. Examples of such demands include, but are not limited to, air-conditioning, water purification techniques, providing condensation of a (Up-Scading) Rankine cycle, as further described below. If there are no refrigeration demands, the low temperature LBP may be used within the MR separation process to improve the economic or energy efficiency of the combined systems.

The LBP, upon exiting from the vaporization heating source exchange, is now fully or partially vaporized LBP and may be further heated by the absorption heat recovered at heat exchanger 140. To further increase the temperature of the LBP, it may then be dosed at dosing step (e.g., 155, FIGS. 26-27) before turbine 160 with appropriate amounts of HBP refrigerant ("HBP"). Managed dosing results in condensing a portion of the LBP and imparting the resulting heat of absorption into the uncondensed LBP. With or without such managed dosing, depending on the need for power generation, the fourth means of heating (solar heat, propane waste engineered heat, exhaust heating) may be incorporated at heat exchanger 150 to provide for better system efficiencies, flexibilities, or higher generation capacity through a turbine or other means.

Managed HBP dosing is injected with dosing injection port 190 to condense the LBP exiting turbine 160 into a MR solution. Such condensation of LBP with HBP will increase the temperature of the MR. The solution may provide further heating (140 and/or 170) of the upstream LBP either before or after the vaporization heat exchanger or super-heater. HBP managed dosing can be performed in either a single step or in multiple steps to optimize the needed temperatures for energy recovery or to optimize the power generated with the available temperatures of the heating sources. The MR may be cooled either to recover the energy and/or to allow for storage at lower pressures.

The separation process at separator 230 is designed to be capable of separating the MR into the LBP and HBP constituents while sporadically available energy (240 & 241) or excess energy is available to operate the MR separation process.

Stored MR may be pumped to pressure to allow for separation of the LBP and HBP through somewhat traditional methods (distillation, successive pressure let-down heating and flashing, multiple affect vacuum distillation, etc.). The actual design of the separation system is optimized based the quantity of energy which is to be stored at the rate of separation required and the temperatures of the intermittent or sporadic sources of such energy.

Energy to be stored (for example, from energy sources (240, 251, FIG. 2)) can originate from any suitable source. Two examples are: a power grid, when excess electric power is available due to high winds and/or an excess of photo voltaic panels receiving a high level of sunlight, such excess energy would be used to operate the MR separation process; or, a thermal solar plant. For novel flexibility, the MR storage and separation phase may be operated independent of the LBP/HBP storage phase and the modified Rankine cycle. This separate operation allows the combined system to both consume and then generate electric power, or the two phases may be operated as a combined system allowing for the cross exchange of heat to be utilized in the separate process to improve the thermal efficiencies of the combined systems, for example as shown in the implementation of FIG. 2.

The remaining Figures illustrate variations and further features employed in various embodiments. Generally, FIGS. 1-8 illustrate variations of systems and processes with a single turbine 160. FIGS. 9-16 illustrate systems and processes employing two turbines operating at different inlet pressures. FIGS. 17-24 illustrate systems and processes using two heat absorption exchangers following the turbines.

Figure 2:
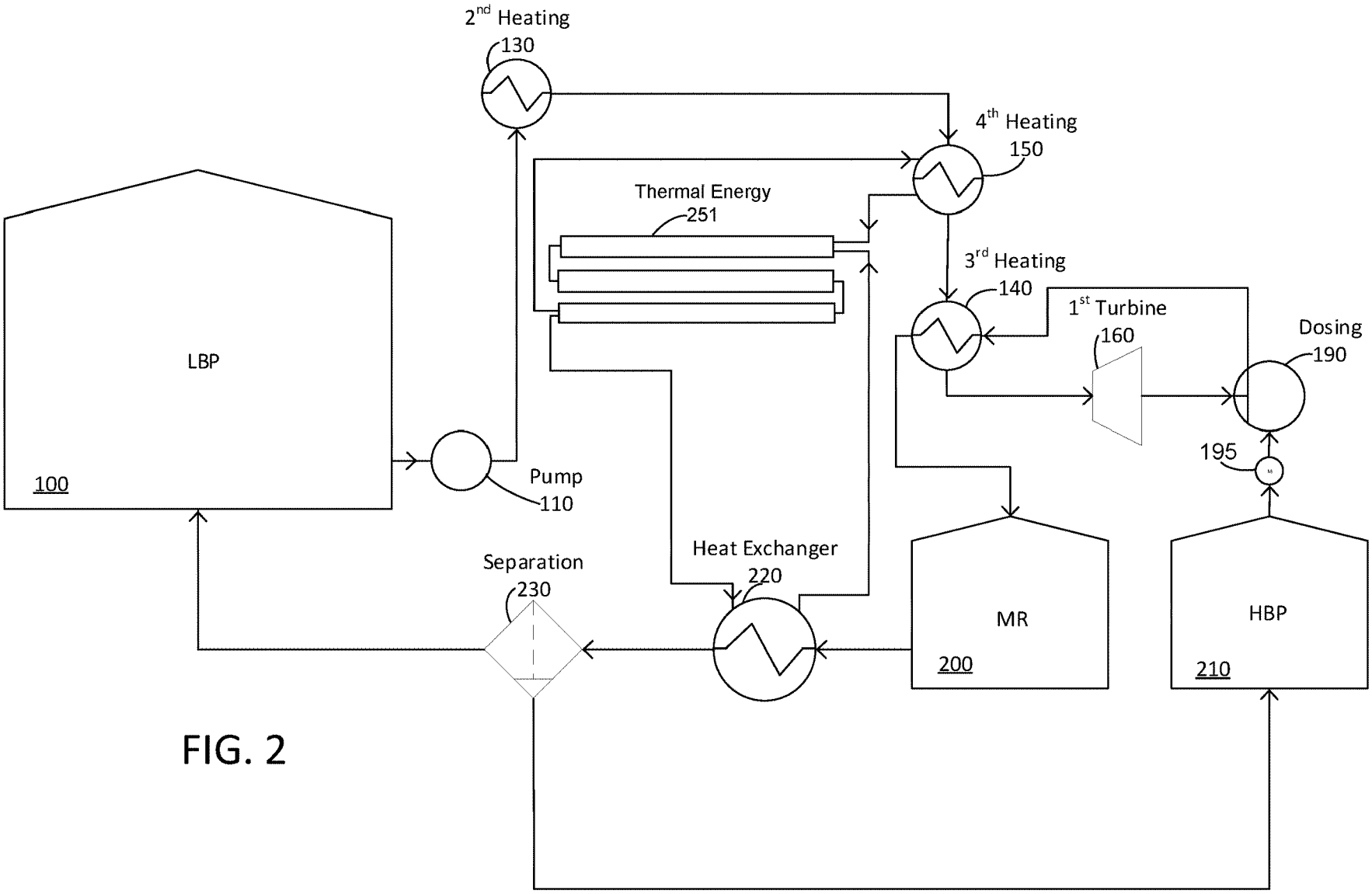
FIG. 2 is a process flow diagram and schematic illustrating the Rankine cycle with a LBP and HBP refrigerant process utilizing thermal energy (solar, geothermal, industrial waste heat, or a hybrid fueled system, etc.) to increase the temperature of LBP to the turbine (single or multistage) and to affect the separation of LBP and HBP from MR.

FIG. 2 is a process flow diagram and schematic illustrating a modified Rankine cycle with a LBP and HBP refrigerant process utilizing thermal energy to increase the temperature of LBP to the turbine and to affect the separation of LBP and HBP from MR. Generally, the depicted system in arranged as that of FIG. 1, with the addition of a thermal energy source 251.

Thermal energy source 251 may be any suitable thermal energy source such as a solar heat collector, a geothermal system, a source of industrial waste heat, or a hybrid fueled system. As depicted, thermal energy source 251 is connected to fourth heat exchanger 150 thermally coupling heat to the LBP. Thermal energy source 251 in this embodiment is also connected to heat exchanger 220 for thermally coupling heat to the MR leaving MR storage vessel 200. As depicted by the flow arrows, the heat exchange preferably takes place with through a liquid medium flowing to and back from heat exchanger 150, and to and from heat exchanger 220.

Figure 3:
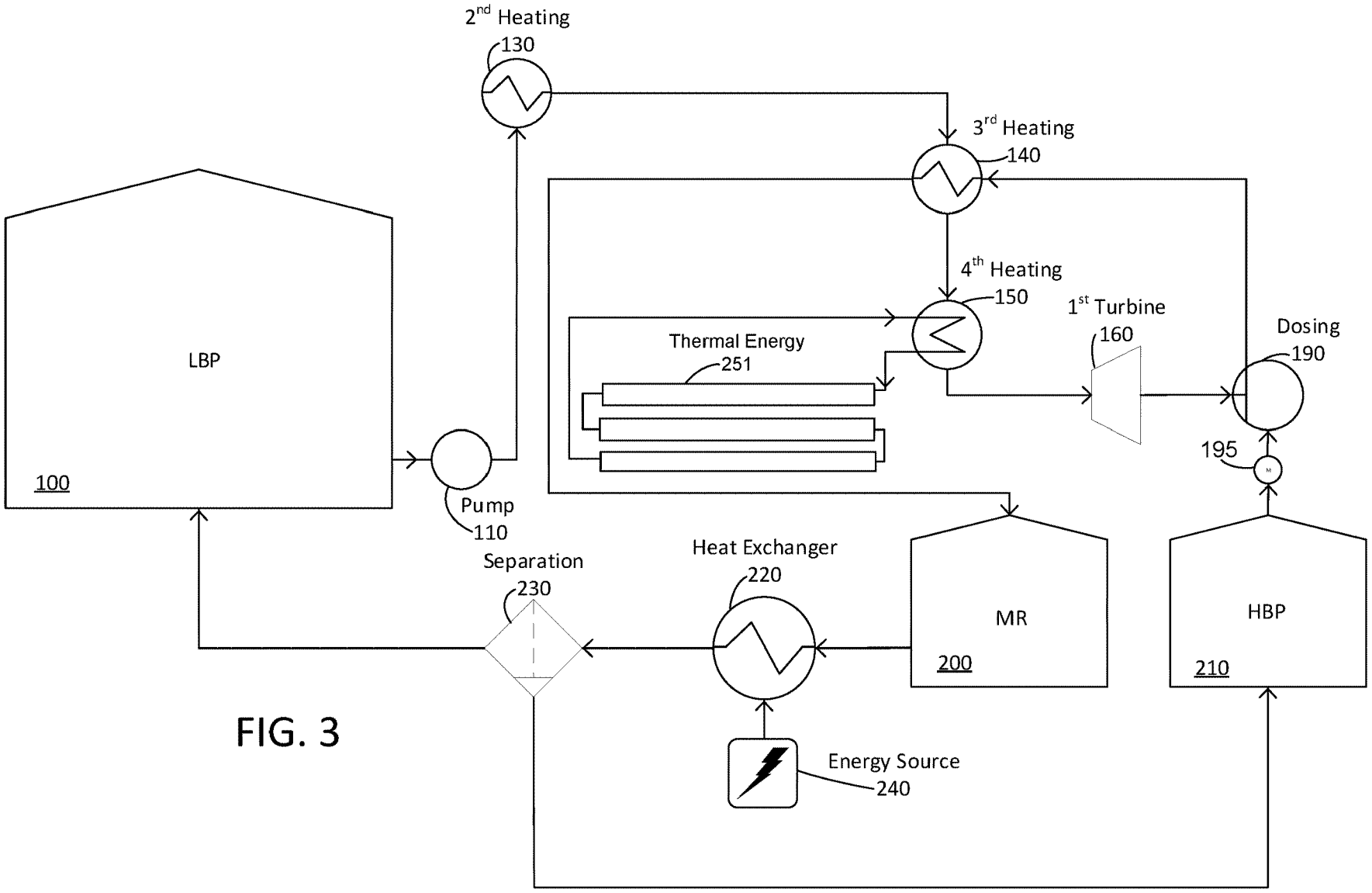
FIG. 3 is a process flow diagram and schematic illustrating the Rankine cycle with a LBP and HBP refrigerant process with use of available excess electrical power (wind, solar power, etc.) f or utilization in separation of the LBP and HBP from the MR. This process flow diagram also utilizes thermal energy (Solar, geothermal, industrial waste heat, or a hybrid field system, etc.) to increase the temperature of the LBP to the turbine (single or multistage).

FIG. 3 is a process flow diagram and schematic illustrating a modified Rankine cycle with a LBP and HBP refrigerant process using available excess electrical power to supply heating and compression in the separation of LBP and HBP from MR. In this embodiment, a thermal energy source 251 is employed to provide thermal energy for heat exchanger 150, while heat exchanger 220 is supplied with heat generated from energy source 240. Energy source 240 is preferably a power grid or local power system powered by wind, solar power, or other intermittent energy source. This combination allows electrical power of energy source 240 to be used for the heating and separation of LBP and HBP when such power is available, but allows the modified Rankine cycle to be used to extract energy assisted by thermal energy source 251, which may be available at times when energy source 240 is not available.

Figure 4:
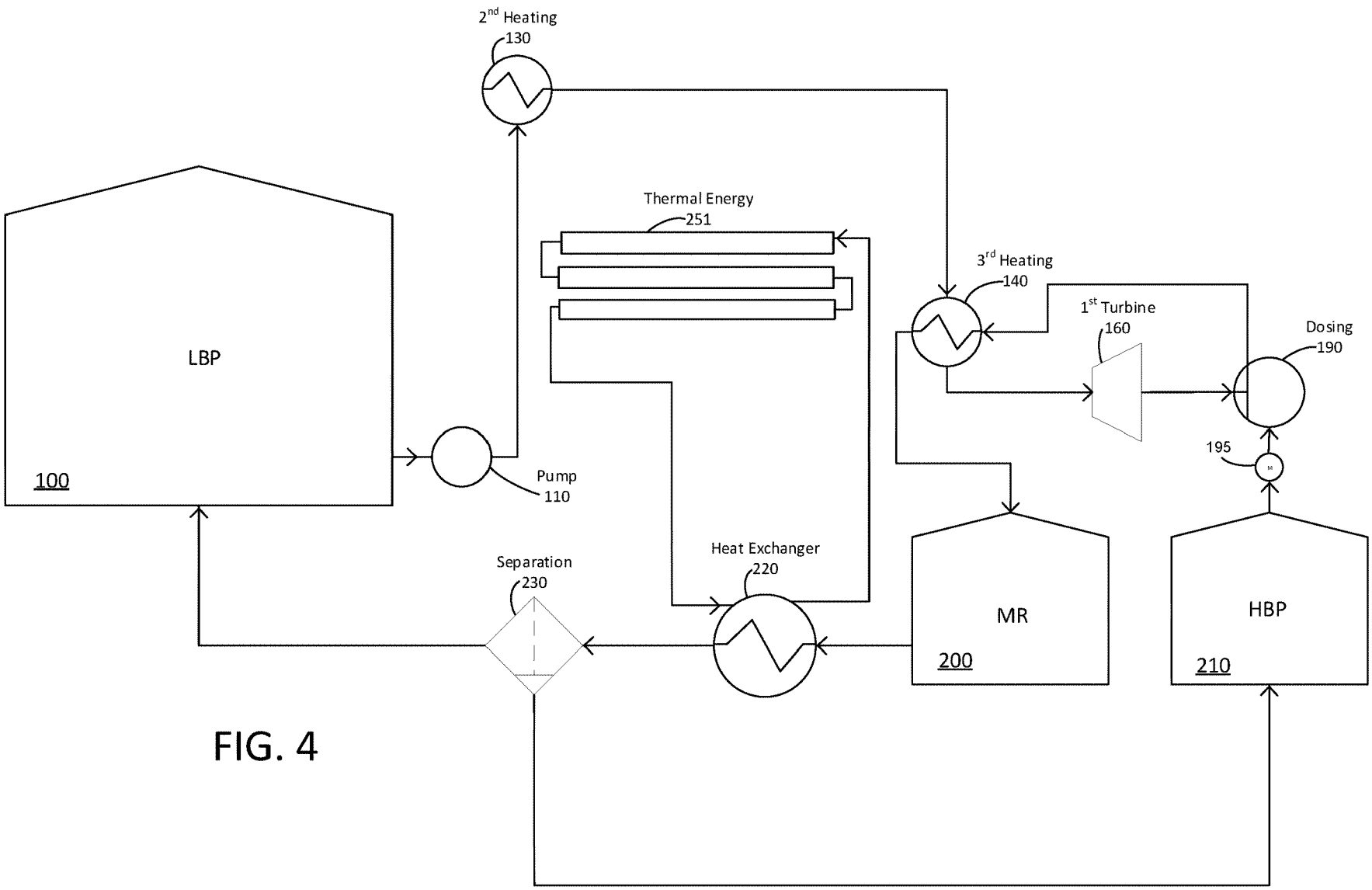
FIG. 4 is a process flow diagram and schematic illustrating the Rankine cycle with a LBP and HBP refrigerant process making use of low grade continuous heating sources to provide on demand or base loaded power, combined with sporadically available thermal energy (solar or non-continuous industrial waste heat to effect the separation of LBP and HBP from MR.

FIG. 4 is a process flow diagram and schematic illustrating a modified Rankine cycle with a LBP and HBP refrigerant process with use of low-grade continuous heating sources to provide on demand or base loaded power, combined with sporadically available thermal energy (solar or non-continuous industrial waste heat) as shown at thermal energy source 251 to effect the separation of LBP and HBP from MR.

Figure 5:
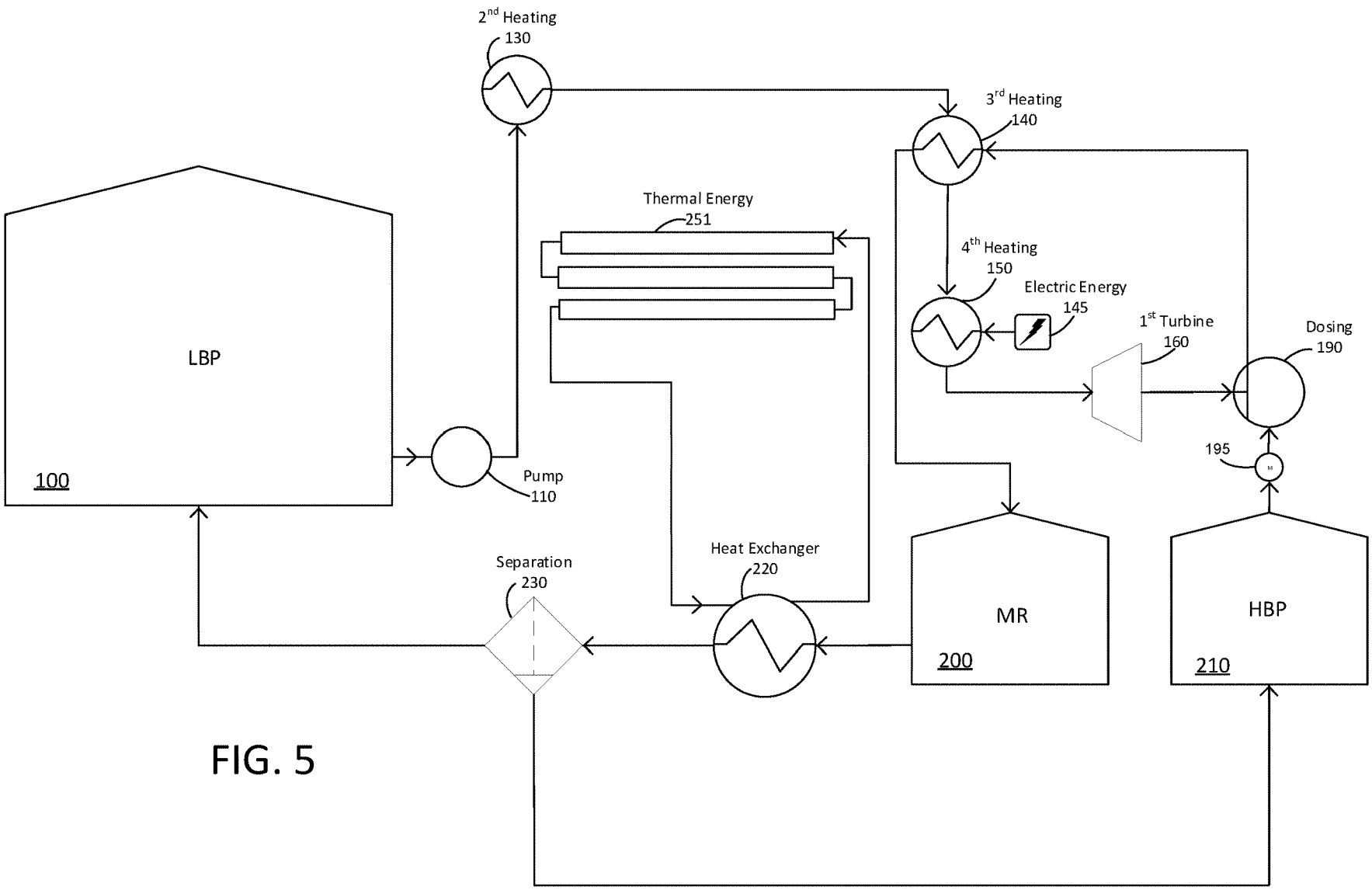
FIG. 5 is a process flow diagram and schematic illustrating the Rankine cycle with a LBP and HBP refrigerant process with use of any source of electrical power to supply minimum super heating of LBP to allow non-condensing turbine operations.

FIG. 5 is a process flow diagram and schematic illustrating a modified Rankine cycle with a LBP and HBP refrigerant process with use of any source of electrical power to supply minimum super heating of LBP to allow non-condensing turbine operations. In this embodiment, fourth heat exchanger 150 provides heat to the LBP using an electrical energy source 145. Heat exchanger 220 is provided heat from thermal energy source 251.

Figure 6:
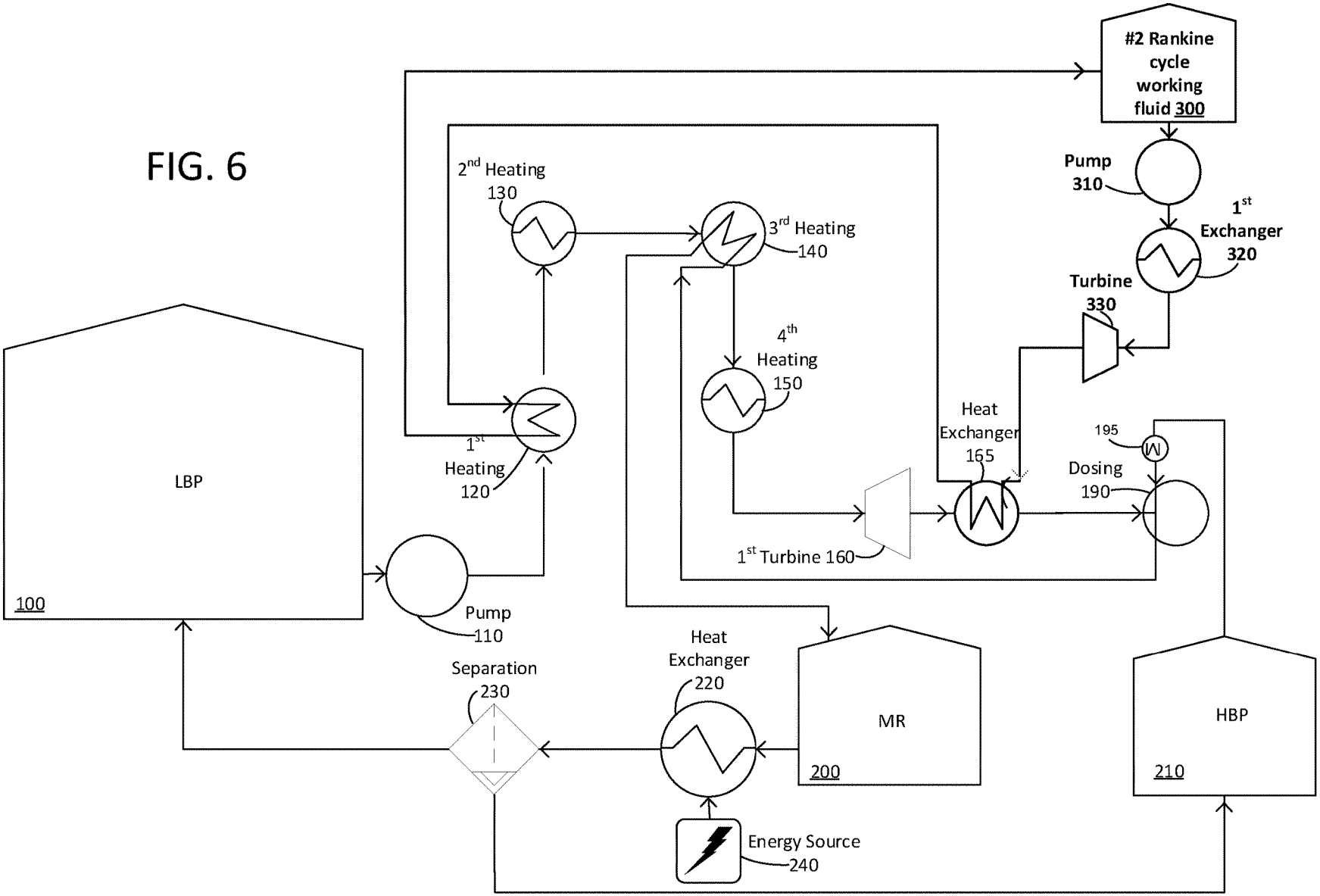
FIG. 6 is a process flow diagram and schematic illustrating the Rankine cycle with LBP and HBP refrigerants in an up-scading (reverse cascading) process.

FIG. 6 is a process flow diagram and schematic illustrating a modified Rankine cycle with LBP and HBP refrigerants in an up-scading (reverse cascading) process with heating sources from electric energy. In this embodiment, a second Rankine cycle is employed to improve the process's energy efficiency. The second cycle is performed with a Rankine sub-system including a working fluid storage vessel 300, a pump 310, a heat exchanger 320, a turbine 330, a heat exchanger 165, and heat exchanger 120.

The Rankine sub-system forms its own working fluid loop. Working fluid storage vessel 300 has an output connected to pump 310. The output of pump 310 is connected to an input of heat exchanger 320, which heats the working fluid, preferably with electrical energy. At the output of heat exchanger 320, the working fluid is fed to an expansion turbine 330, which drives a generator or mechanical working shaft similar to turbine 160. At the output of expansion turbine 330, the working fluid is fed to heat exchanger 165, which is thermally coupled into the original modified Rankine cycle at the output of turbine 160. The higher temperature at output of turbine 160 heats the working fluid, which then passes to heat exchanger 120 to heat lower temperature LBP from pump 110. Finally, the working fluid passes back to working fluid storage vessel 300 from an output of heat exchanger 120. The turbine output dosing step (190) therefore serves to both help condense the vapor at the turbine output and indirectly to heat the LBP leaving LBP storage at (100). This process employs what might have been wasted heat to use it as a heating source for the overall cycle. A third cycle may also be added (typically using a different refrigerant) connecting to heat exchanger 320.

Figure 7:
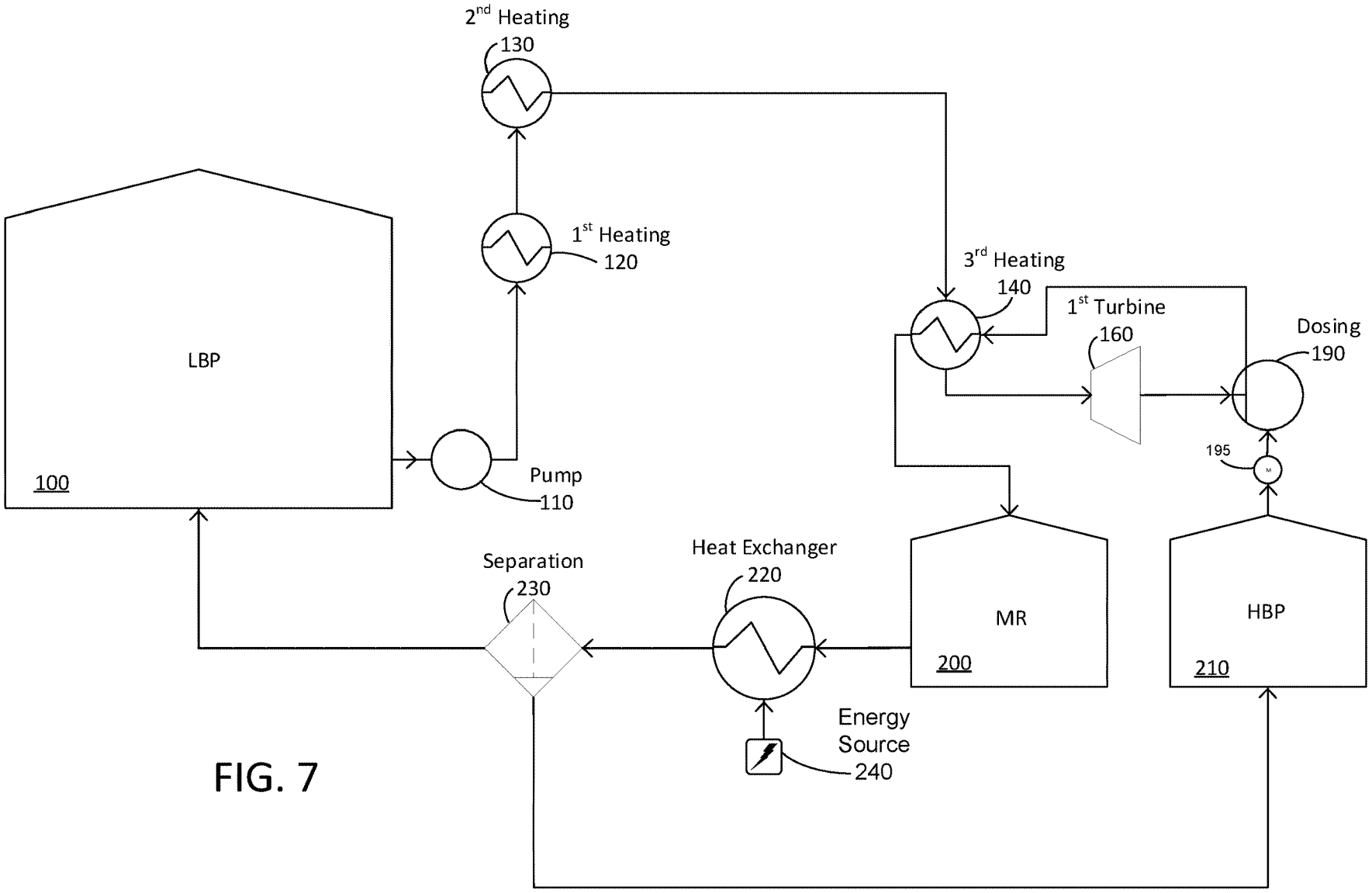
FIG. 7 is a process flow diagram and schematic illustrating the Rankine cycle with a LBP and HBP refrigerant process with use of refrigeration demands to effect initial heating of LBP followed by atmospheric (or other available heating) to generate electrical power.

FIG. 7 is a process flow diagram and schematic illustrating the Rankine cycle with a LBP and HBP refrigerant process with use of refrigeration demands to effect initial heating of LBP followed by atmospheric (or other available heating) to generate electrical power. A portion of the electrical power is used to maintain continuous operation of LBP and HBP separation from MR. With continuous operation, storage can be minimized but quickly ramped up when excess grid power (for example, from solar or wind) becomes available.

Figure 8:
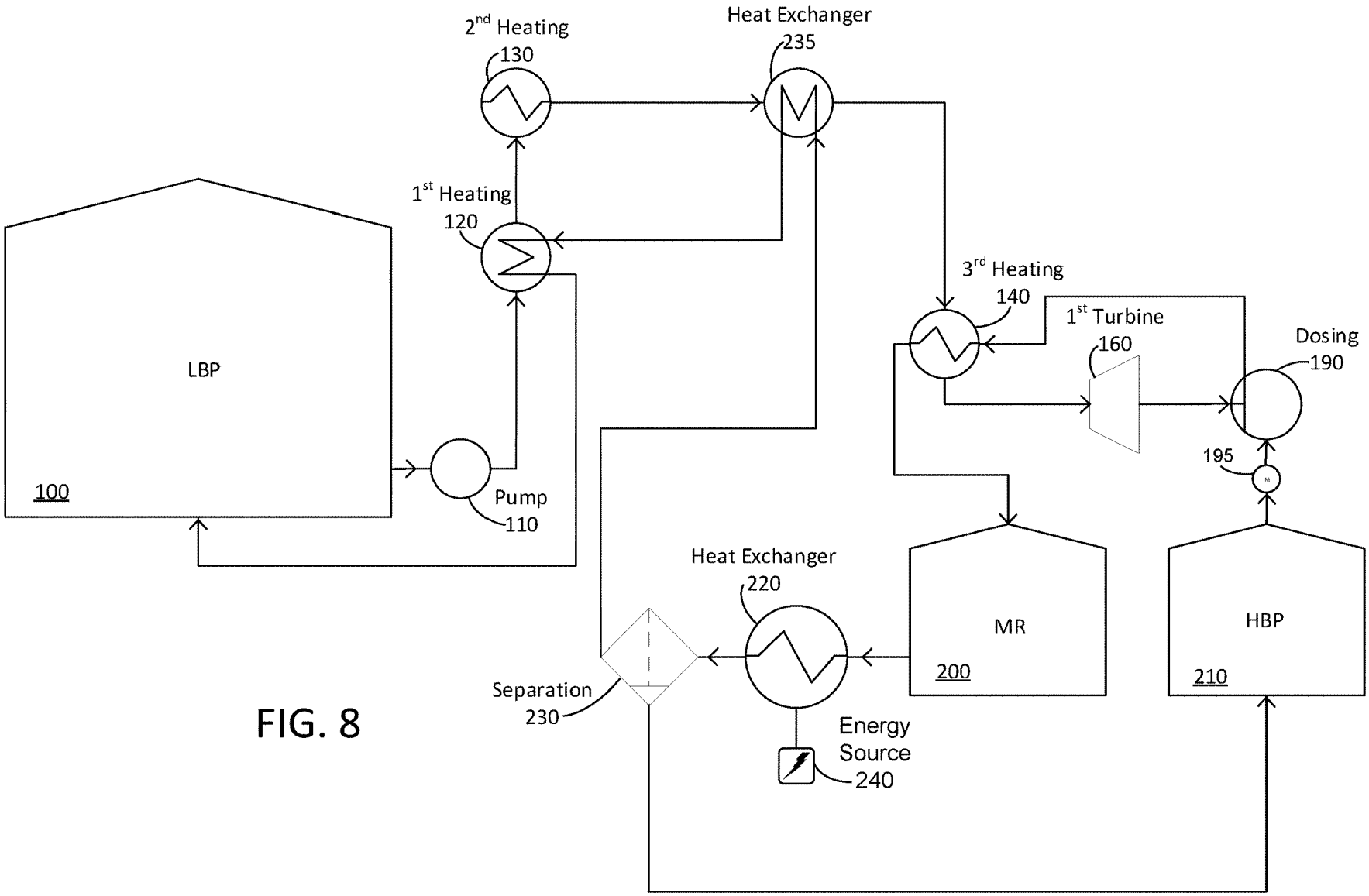
FIG. 8 is a process flow diagram and schematic illustrating the Rankine cycle with a LBP and HBP refrigerant process with use of recapturing the refrigeration of the LBP for storage.

FIG. 8 is a process flow diagram and schematic illustrating the Rankine cycle with a LBP and HBP refrigerant process with use of recapturing the refrigeration of the LBP for storage. In this embodiment, an additional heat exchanger 235 is connected to the LBP-side output of separator 230. Heat exchanger 235 is thermally coupled into the LBP flow path to turbine 160 to provide additional heating of the LBP following heat exchanger 130. An output of heat exchanger 235 is connected to an input of heat exchanger 120 to add further thermal energy to the LBP exiting pump 110. An output of heat exchanger 120 then feeds the LBP to LBP storage vessel 100.

Figure 9:
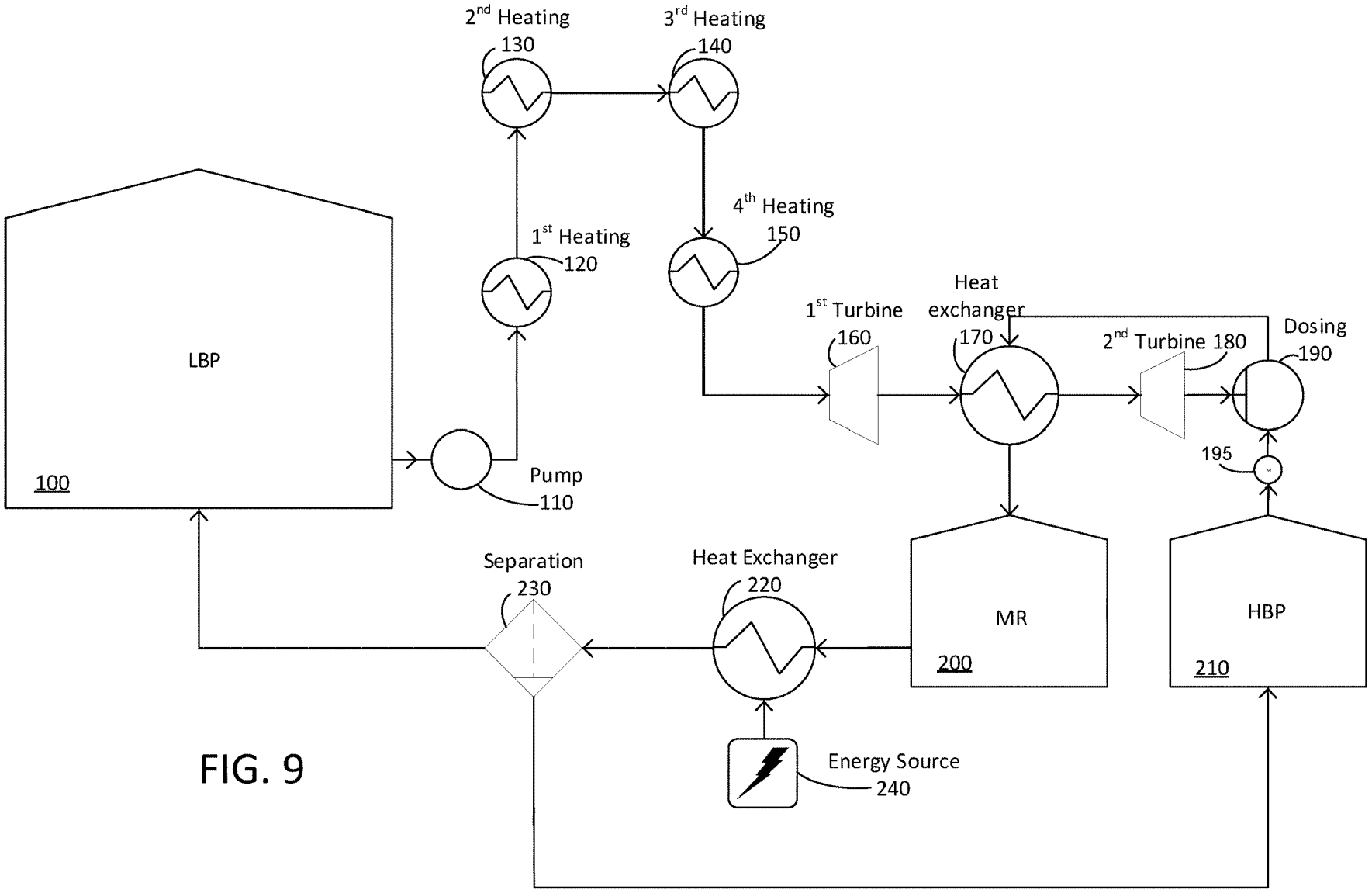
FIG. 9 is a process flow diagram and schematic illustrating a modified Rankine cycle similar to that of FIG. 1 using two turbines with heat absorption in one location.

FIG. 9 is a process flow diagram and schematic illustrating a modified Rankine cycle similar to that of FIG. 1 using two turbines with heat absorption in one location. A second turbine 180 and a heat exchanger 170 are added between turbine 160 and dosing injection port 190. The output of dosing value 190 is connected to an input of heat exchanger 170, rather than heat exchanger 140, to further transfer heat from the turbine exhaust of turbine 160.

Figure 10:
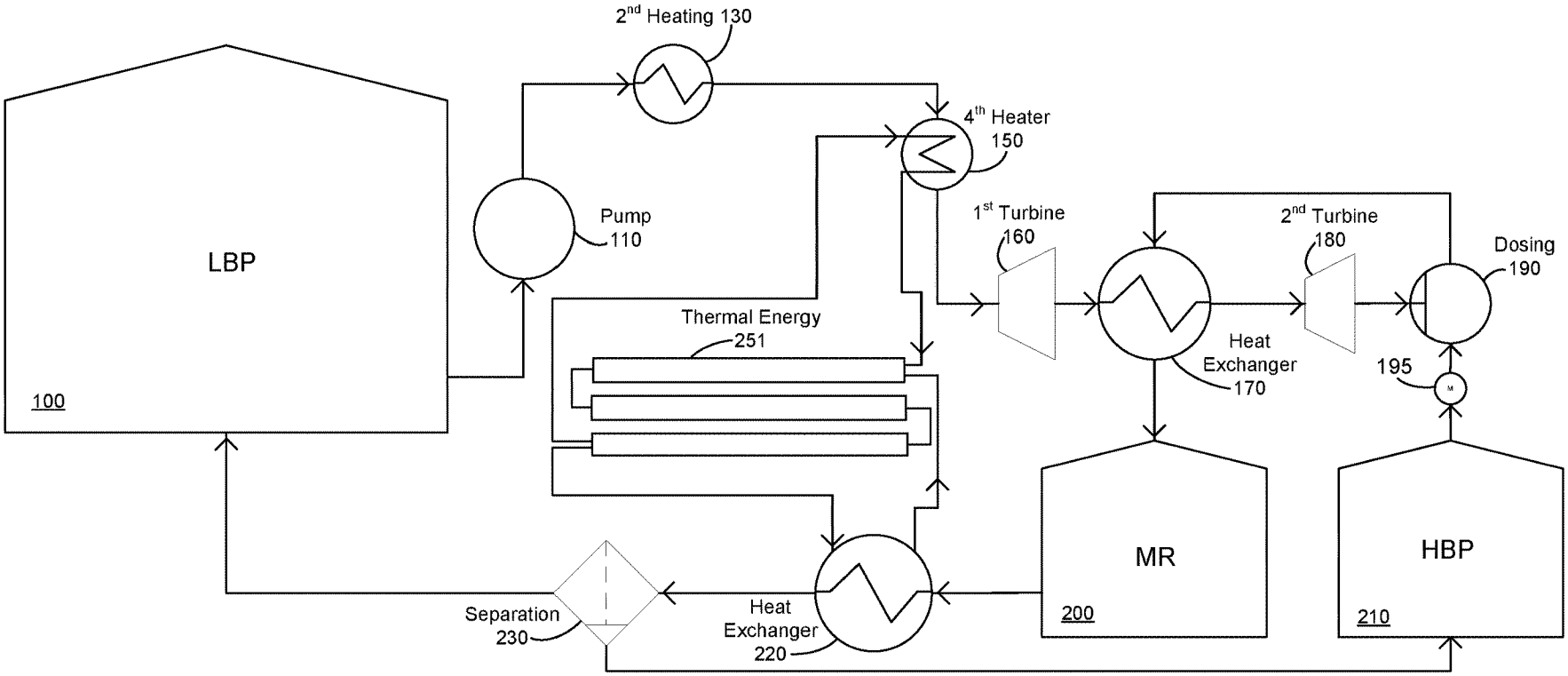
FIG. 10 is a process flow diagram and schematic illustrating a modified Rankine cycle similar to that of FIG. 2 using two turbines with heat absorption in one location.

FIG. 10 is a process flow diagram and schematic illustrating a modified Rankine cycle similar to that of FIG. 2 using two turbines with heat absorption in one location. Again, second turbine 180 and heat exchanger 170 are added between turbine 160 and dosing injection port 190, with the output of dosing value 190 connected to an input of heat exchanger 170.

Figure 11:
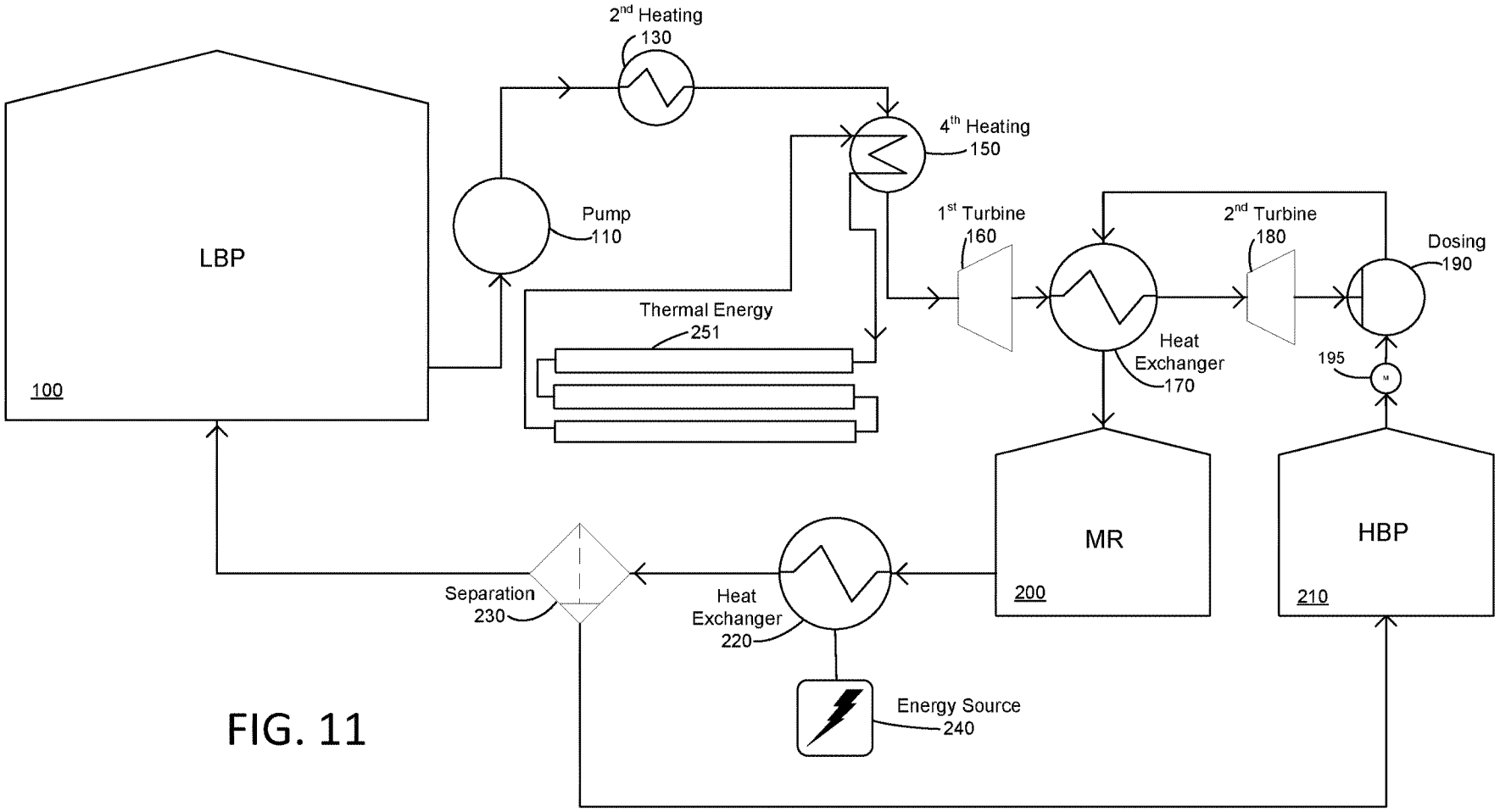
FIG. 11 is a process flow diagram and schematic illustrating a modified Rankine cycle similar to that of FIG. 3 using two turbines with heat absorption in one location.

FIG. 11 is a process flow diagram and schematic illustrating a modified Rankine cycle similar to that of FIG. 3 using two turbines with heat absorption in one location. Second turbine 180 and heat exchanger 170 are added between turbine 160 and dosing injection port 190, with the output of dosing value 190 connected to an input of heat exchanger 170.

Figure 12:
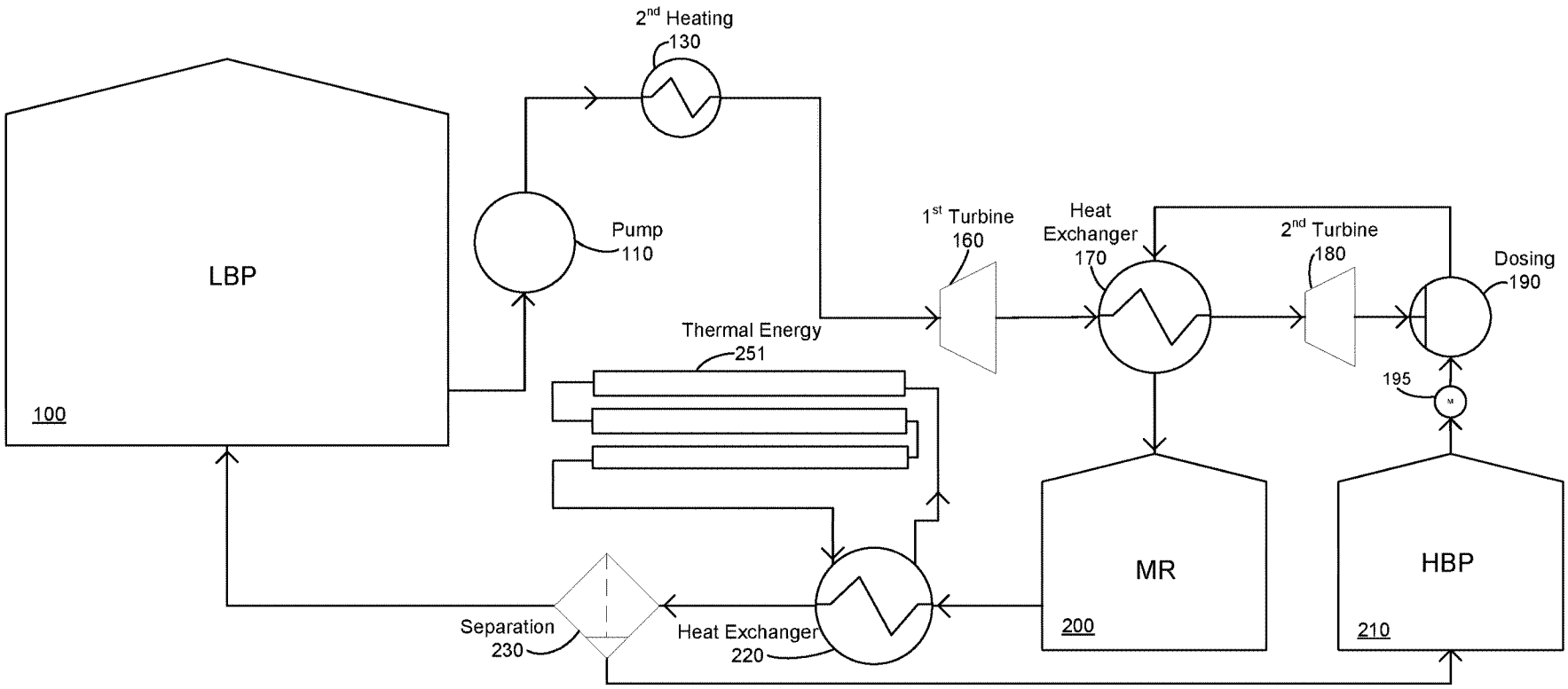
FIG. 12 is a process flow diagram and schematic illustrating a modified Rankine cycle similar to that of FIG. 4 using two turbines with heat absorption in one location.

FIG. 12 is a process flow diagram and schematic illustrating a modified Rankine cycle similar to that of FIG. 4 using two turbines with heat absorption in one location. Second turbine 180 and heat exchanger 170 are added between turbine 160 and dosing injection port 190, with the output of dosing value 190 connected to an input of heat exchanger 170 rather than to heat exchanger 140 as in FIG. 4.

Figure 13:
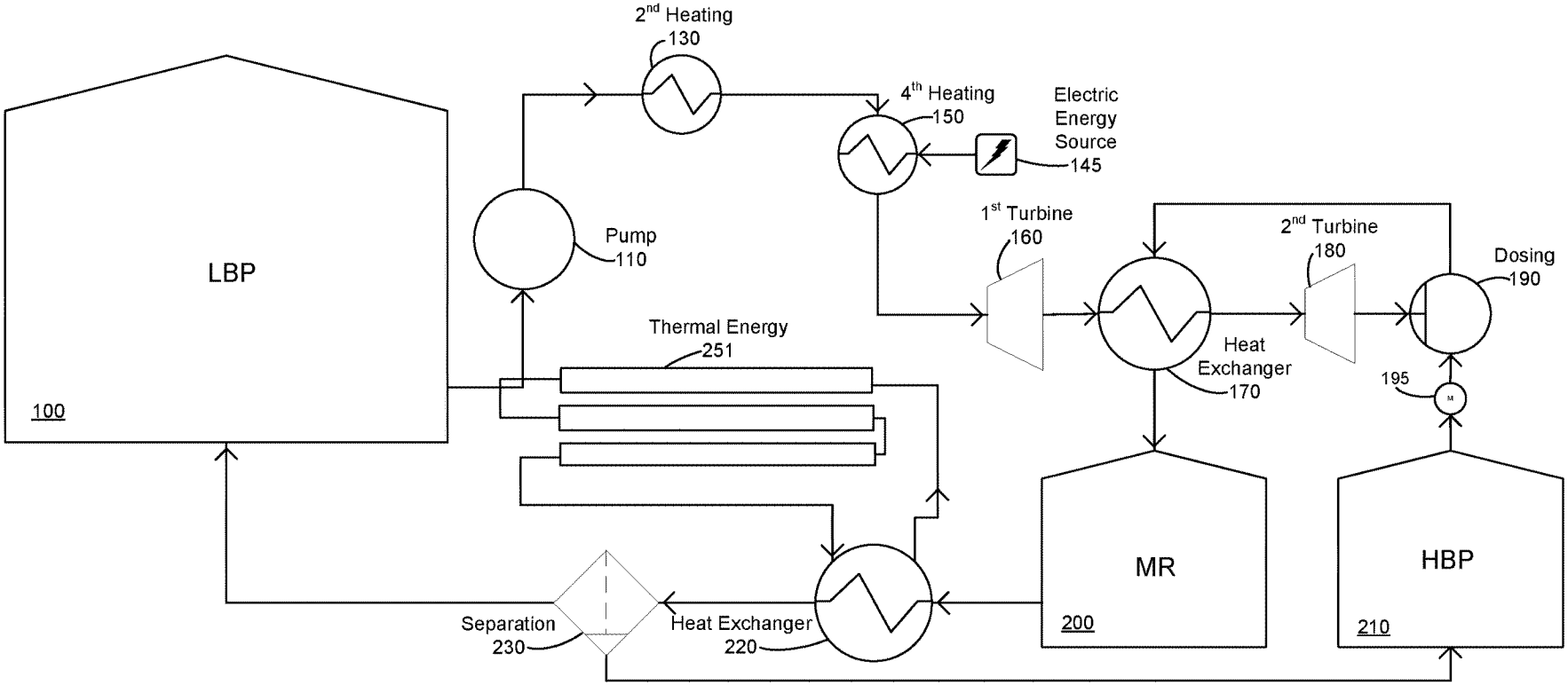
FIG. 13 is a process flow diagram and schematic illustrating a modified Rankine cycle similar to that of FIG. 5 using two turbines with heat absorption in one location.

FIG. 13 is a process flow diagram and schematic illustrating a modified Rankine cycle similar to that of FIG. 5 using two turbines with heat absorption in one location. Second turbine 180 and heat exchanger 170 are added between turbine 160 and dosing injection port 190, with the output of dosing value 190 connected to an input of heat exchanger 170 rather than to heat exchanger 140.

Figure 14:
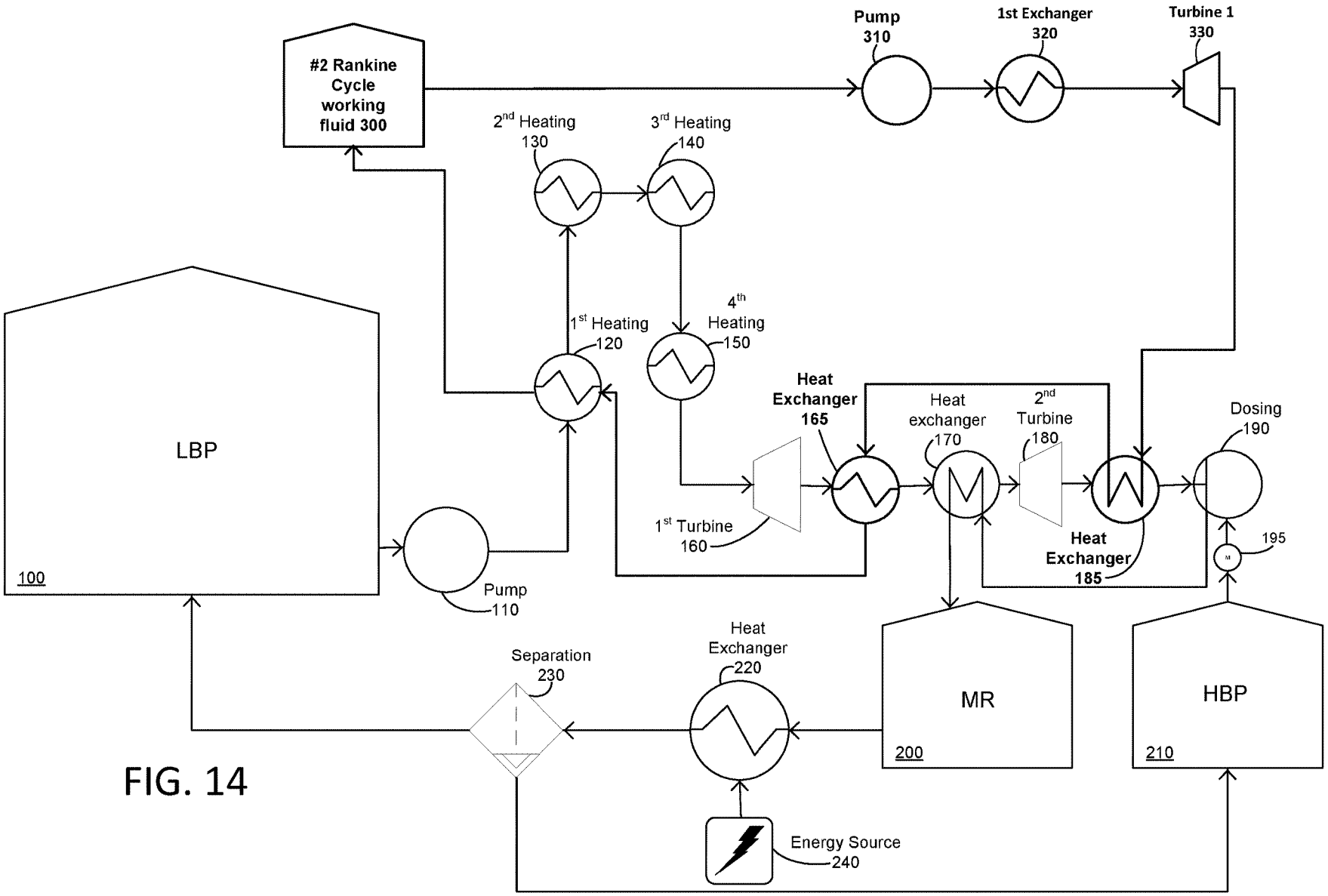
FIG. 14 is a process flow diagram and schematic illustrating a modified Rankine cycle similar to that of FIG. 6 using two turbines with heat absorption in one location.

FIG. 14 is a process flow diagram and schematic illustrating a modified Rankine cycle similar to that of FIG. 6 using two turbines with heat absorption in one location. Second turbine 180 and heat exchanger 170 are added between turbine 160 and dosing injection port 190, with the output of dosing value 190 connected to an input of heat exchanger 170 rather than to heat exchanger 140. An additional heat exchanger 185 is also included, connected between the output of turbine 18 and the input of dosing injection port 190 to provide additional heat to the second Rankine cycle including working fluid 300, pump 310, heat exchanger 320, turbine 330, heat exchanger 165, and heat exchanger 185.

Figure 15:
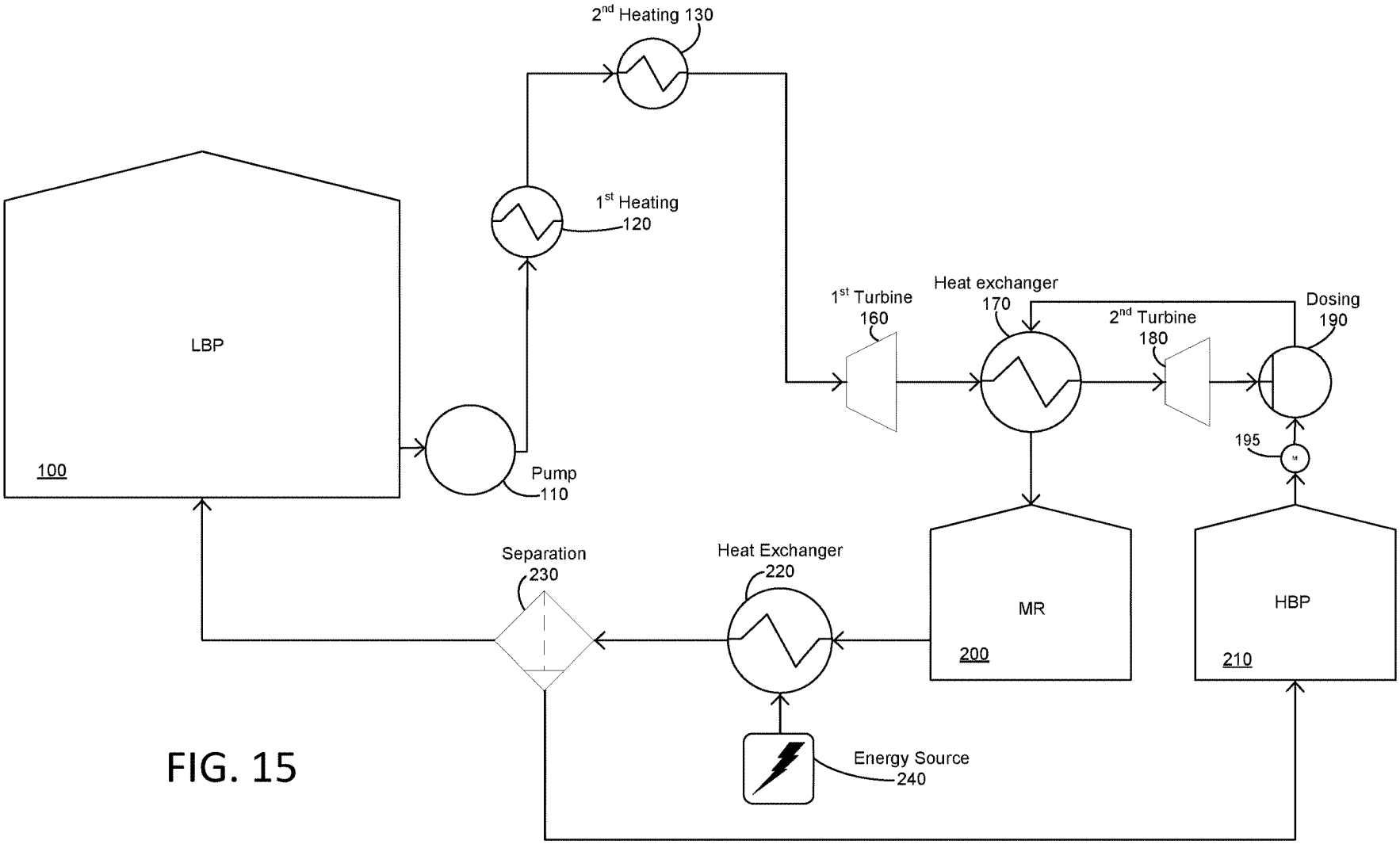
FIG. 15 is a process flow diagram and schematic illustrating a modified Rankine cycle similar to that of FIG. 7 using two turbines with heat absorption in one location.

FIG. 15 is a process flow diagram and schematic illustrating a modified Rankine cycle similar to that of FIG. 7 using two turbines with heat absorption in one location. Second turbine 180 and heat exchanger 170 are added between turbine 160 and dosing injection port 190, with the output of dosing value 190 connected to an input of heat exchanger 170 rather than to heat exchanger 140.

Figure 16:
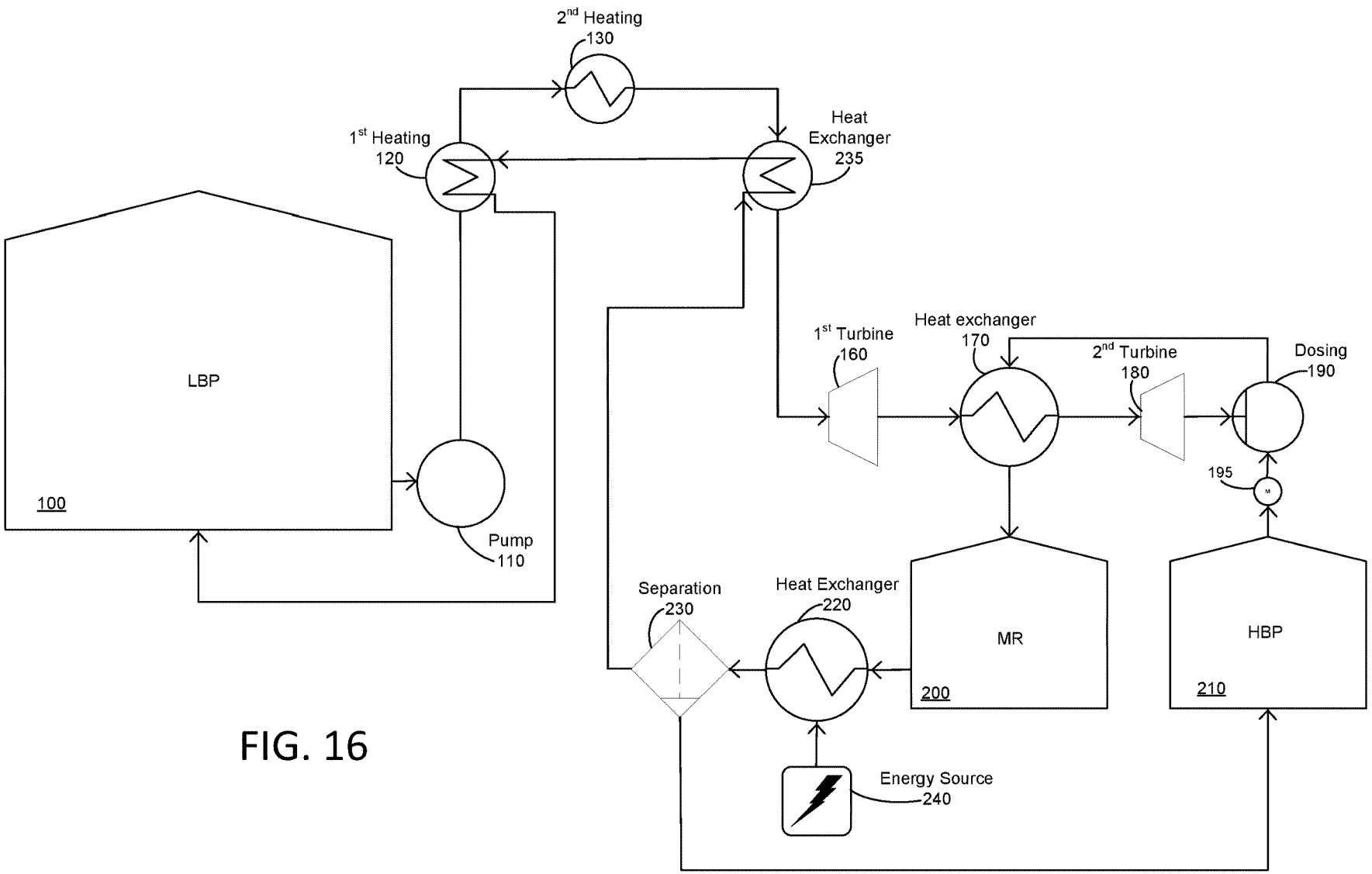
FIG. 16 is a process flow diagram and schematic illustrating a modified Rankine cycle similar to that of FIG. 8 using two turbines with heat absorption in one location.

FIG. 16 is a process flow diagram and schematic illustrating a modified Rankine cycle similar to that of FIG. 8 using two turbines with heat absorption in one location. Second turbine 180 and heat exchanger 170 are added between turbine 160 and dosing injection port 190, with the output of dosing value 190 connected to an input of heat exchanger 170.

Figure 17:
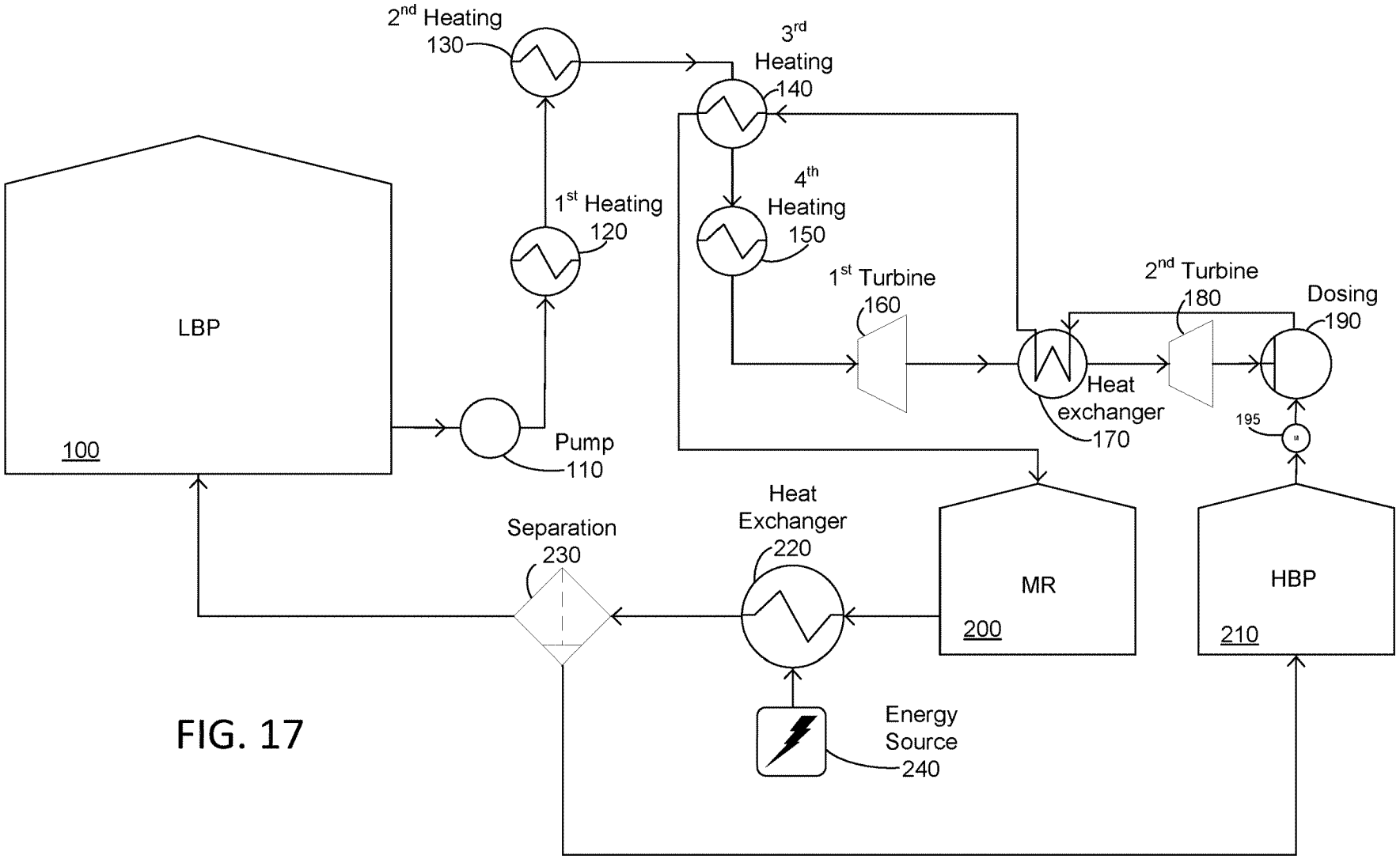
FIG. 17 is a process flow diagram and schematic illustrating a modified Rankine cycle similar to that of FIG. 9 using two turbines with heat absorption in two locations.

FIG. 17 is a process flow diagram and schematic illustrating a modified Rankine cycle similar to that of FIG. 9 using two turbines with heat absorption in two locations. The output of dosing injection port 190 is connected to heat exchanger 170 as in the embodiment of FIG. 9, and then fed to heat exchanger 140, to provide additional heating for the LBP.

Figure 18:
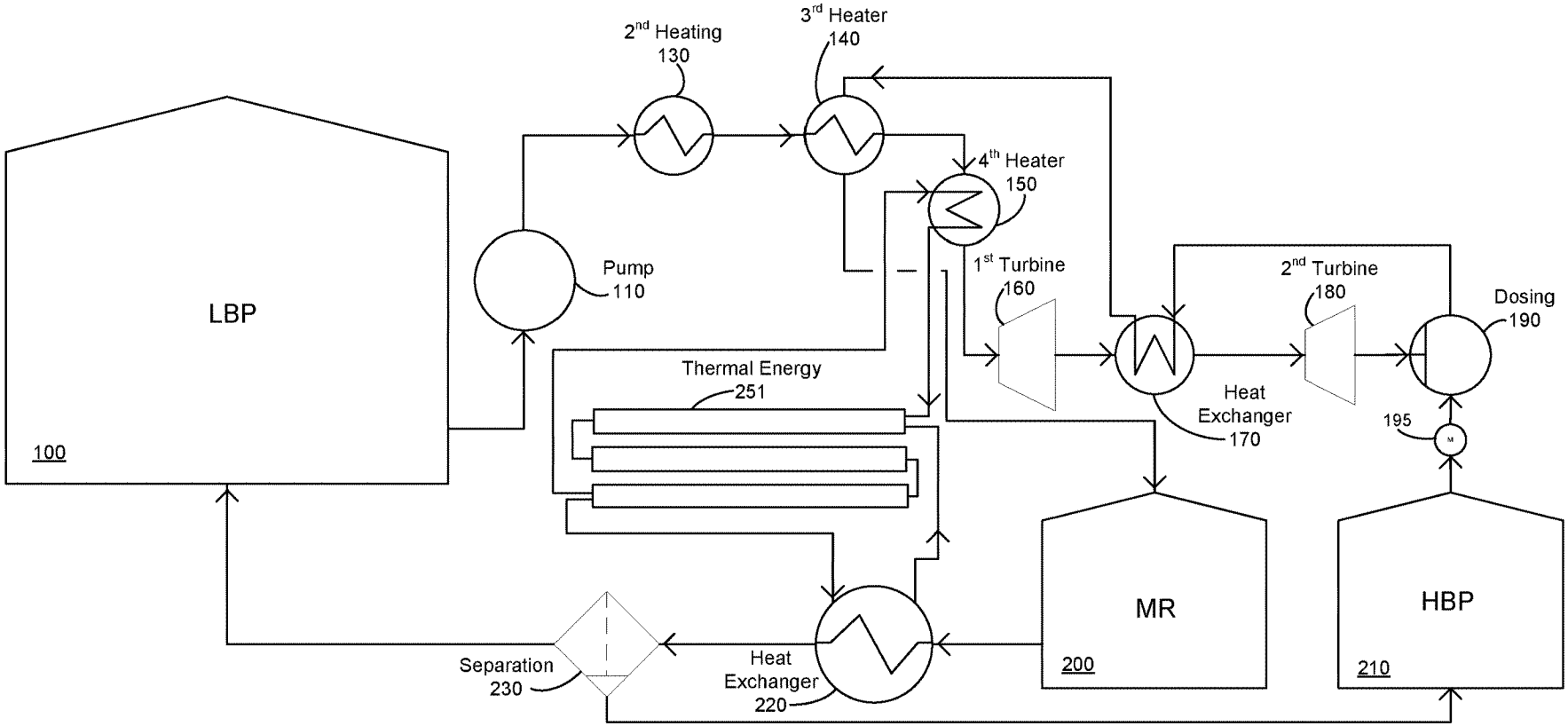
FIG. 18 is a process flow diagram and schematic illustrating a modified Rankine cycle similar to that of FIG. 10 using two turbines with heat absorption in two locations.

FIG. 18 is a process flow diagram and schematic illustrating a modified Rankine cycle similar to that of FIG. 10 using two turbines with heat absorption in two locations. The output of dosing injection port 190 is connected to heat exchanger 170, and then fed to heat exchanger 140, to provide additional heating for the LBP.

Figure 19:
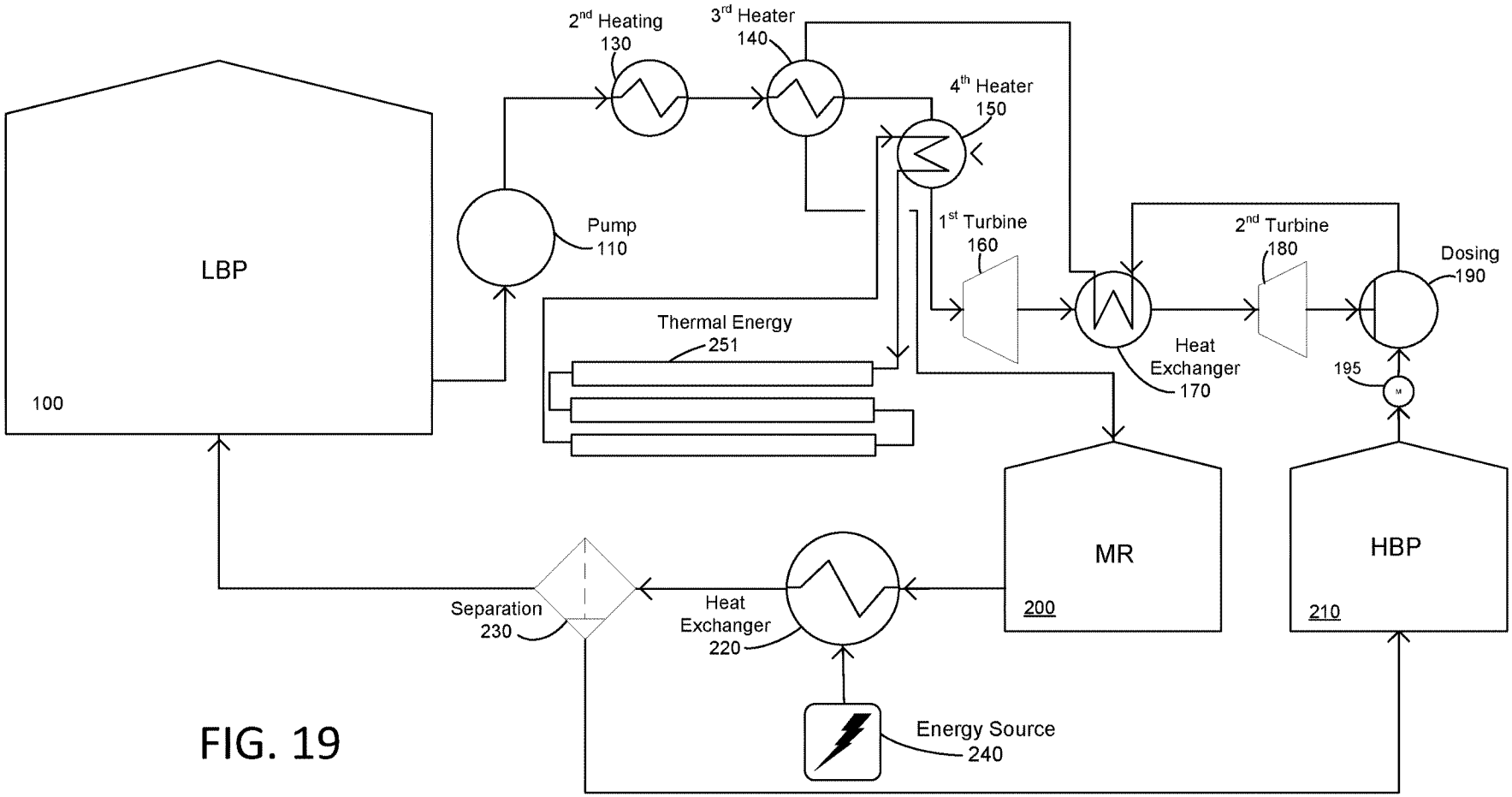
FIG. 19 is a process flow diagram and schematic illustrating a modified Rankine cycle similar to that of FIG. 11 using two turbines with heat absorption in two locations.

FIG. 19 is a process flow diagram and schematic illustrating a modified Rankine cycle similar to that of FIG. 11 using two turbines with heat absorption in two locations. The output of dosing injection port 190 is connected to heat exchanger 170 as in the embodiment of FIG. 11, and then fed to heat exchanger 140, to provide additional heating for the LBP. From there, the MR is fed to MR storage vessel 200.

Figure 20:
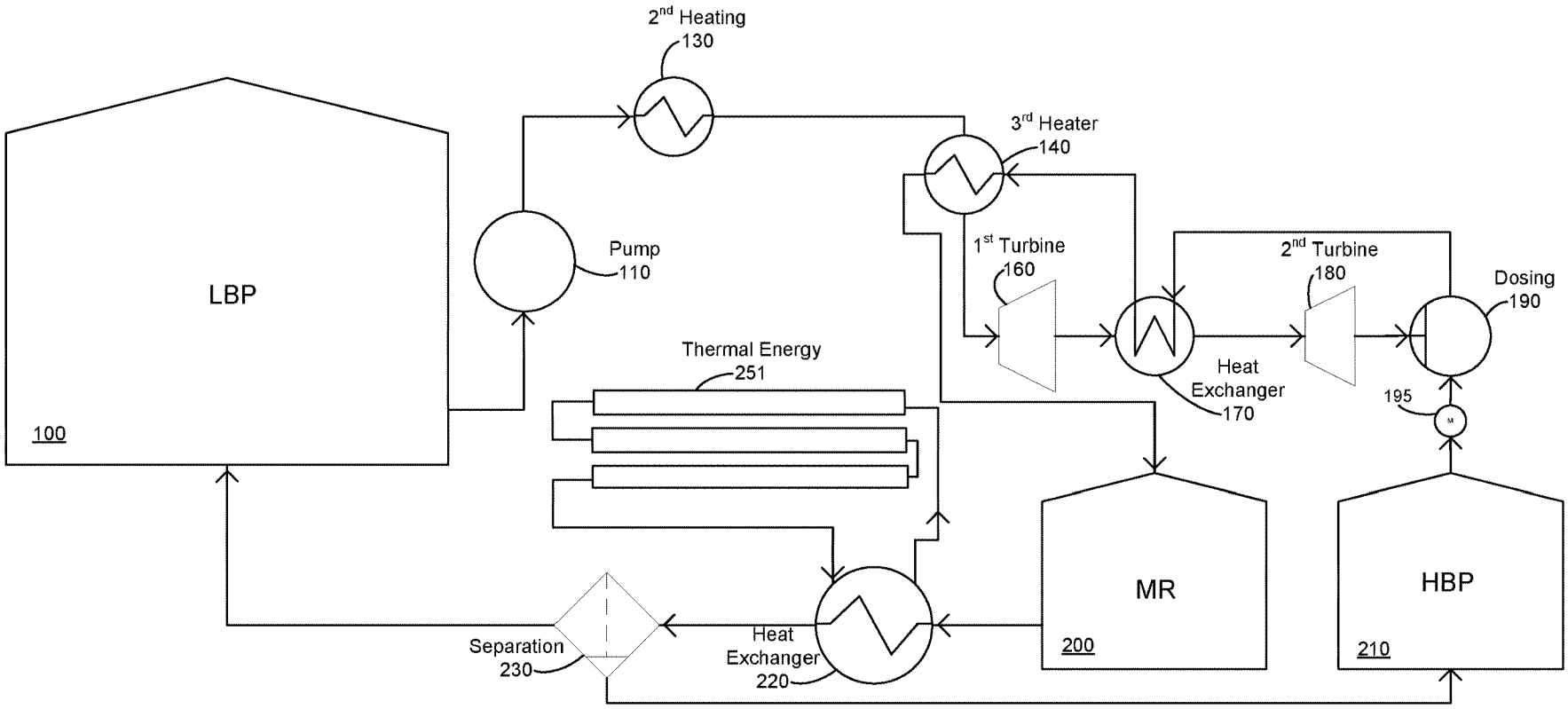
FIG. 20 is a process flow diagram and schematic illustrating a modified Rankine cycle similar to that of FIG. 12 using two turbines with heat absorption in two locations.

FIG. 20 is a process flow diagram and schematic illustrating a modified Rankine cycle similar to that of FIG. 12 using two turbines with heat absorption in two locations. The output of dosing injection port 190 is connected to heat exchanger 170, and then fed to heat exchanger 140, to provide additional heating for the LBP.

Figure 21:
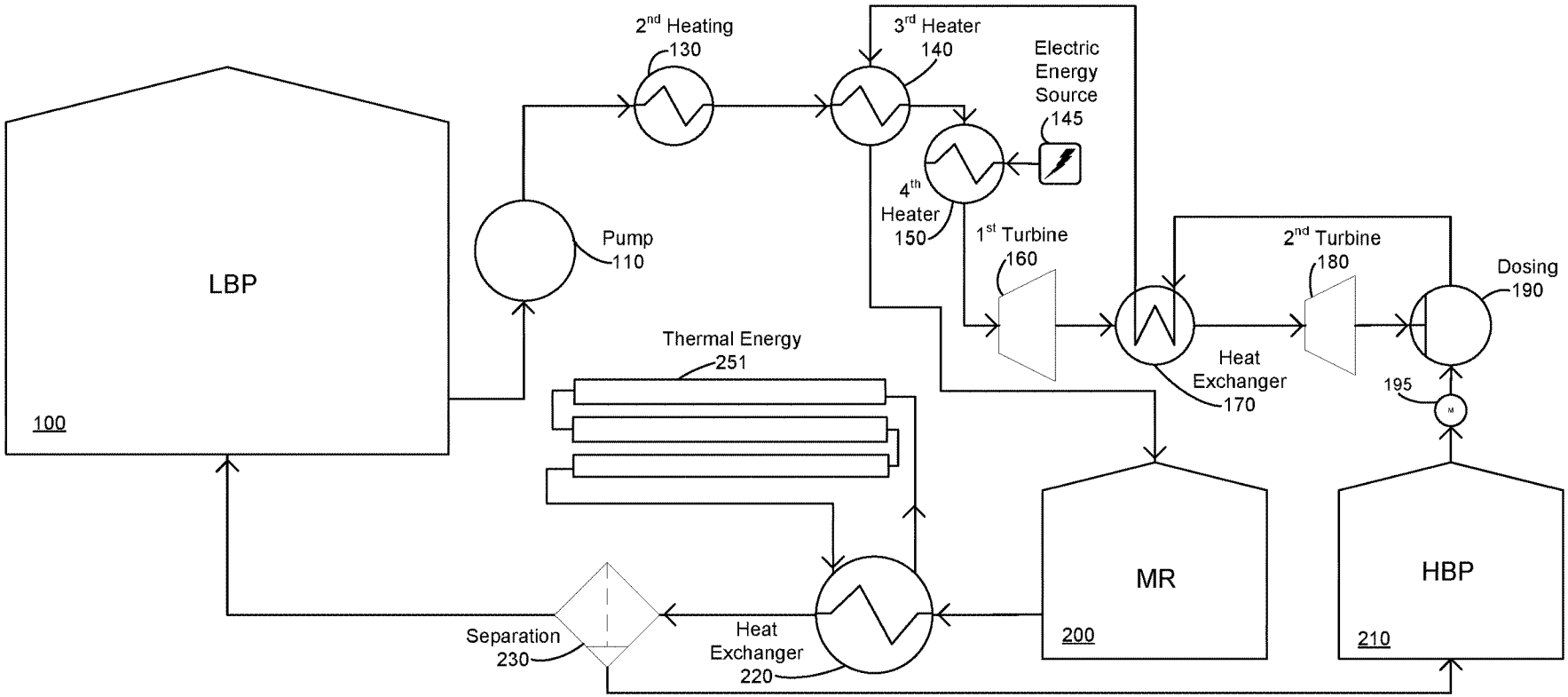
FIG. 21 is a process flow diagram and schematic illustrating a modified Rankine cycle similar to that of FIG. 13 using two turbines with heat absorption in two locations.

FIG. 21 is a process flow diagram and schematic illustrating a modified Rankine cycle similar to that of FIG. 13 using two turbines with heat absorption in two locations. The output of dosing injection port 190 is connected to heat exchanger 170, and then fed to heat exchanger 140, to provide additional heating for the LBP.

Figure 22:
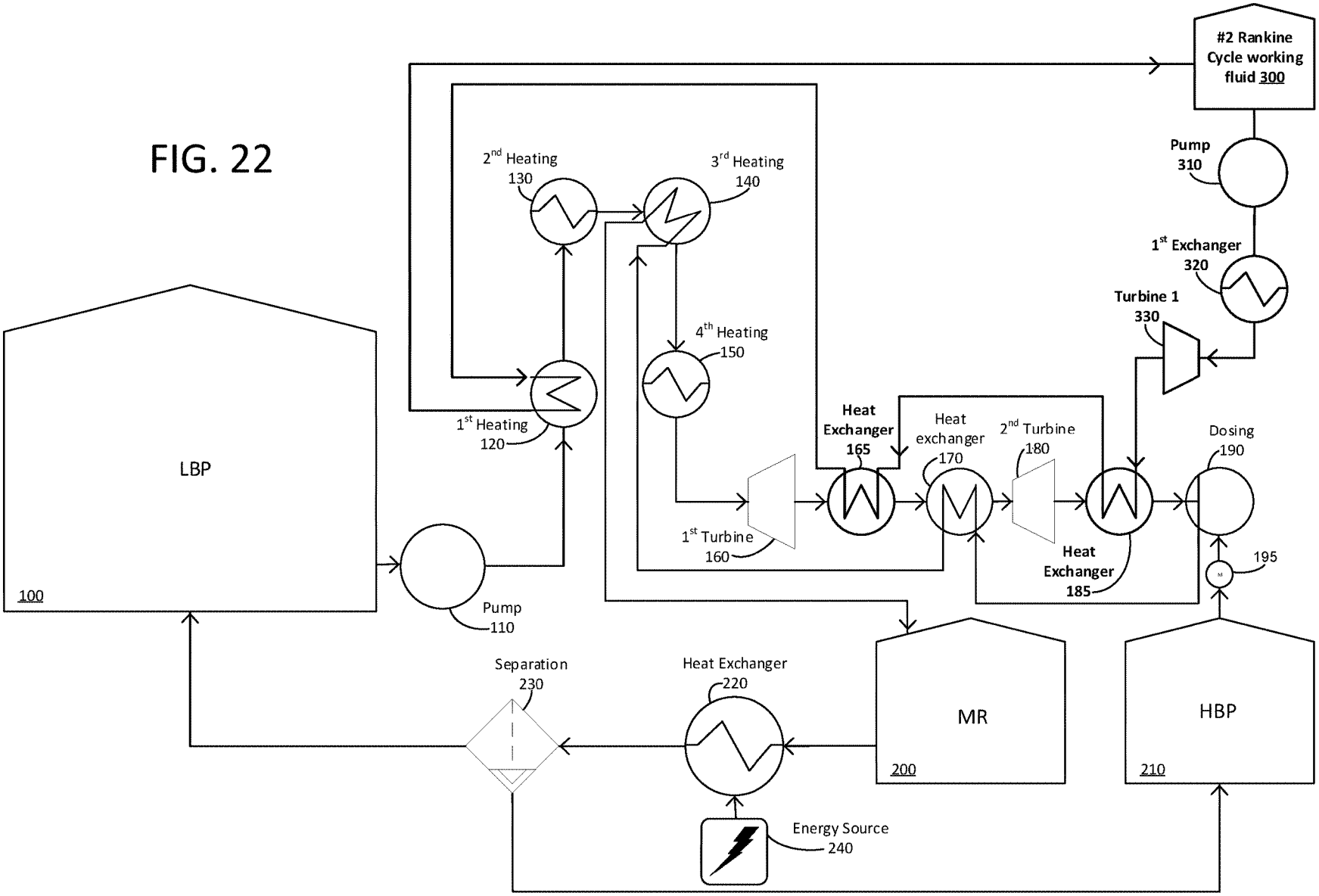
FIG. 22 is a process flow diagram and schematic illustrating a modified Rankine cycle similar to that of FIG. 14 using two turbines with heat absorption in two locations.

FIG. 22 is a process flow diagram and schematic illustrating a modified Rankine cycle similar to that of FIG. 14 using two turbines with heat absorption in two locations. The output of dosing injection port 190 is connected to heat exchanger 170, and then fed to heat exchanger 140, to provide additional heating for the LBP.

Figure 23:
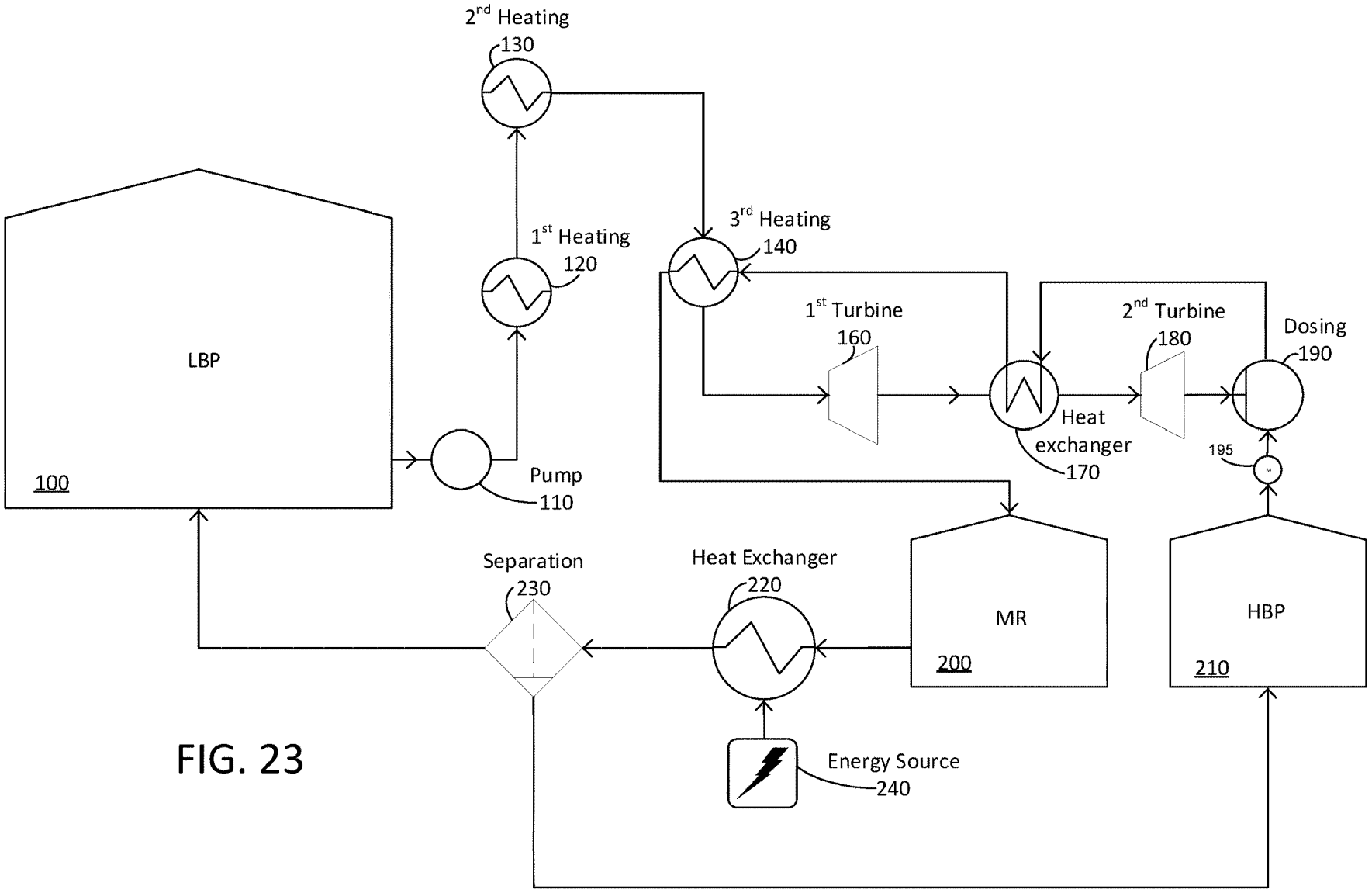
FIG. 23 is a process flow diagram and schematic illustrating a modified Rankine cycle similar to that of FIG. 15 using two turbines with heat absorption in two locations.

FIG. 23 is a process flow diagram and schematic illustrating a modified Rankine cycle similar to that of FIG. 15 using two turbines with heat absorption in two locations. The output of dosing injection port 190 is connected to heat exchanger 170, and then fed to heat exchanger 140, to provide additional heating for the LBP.

Figure 24:
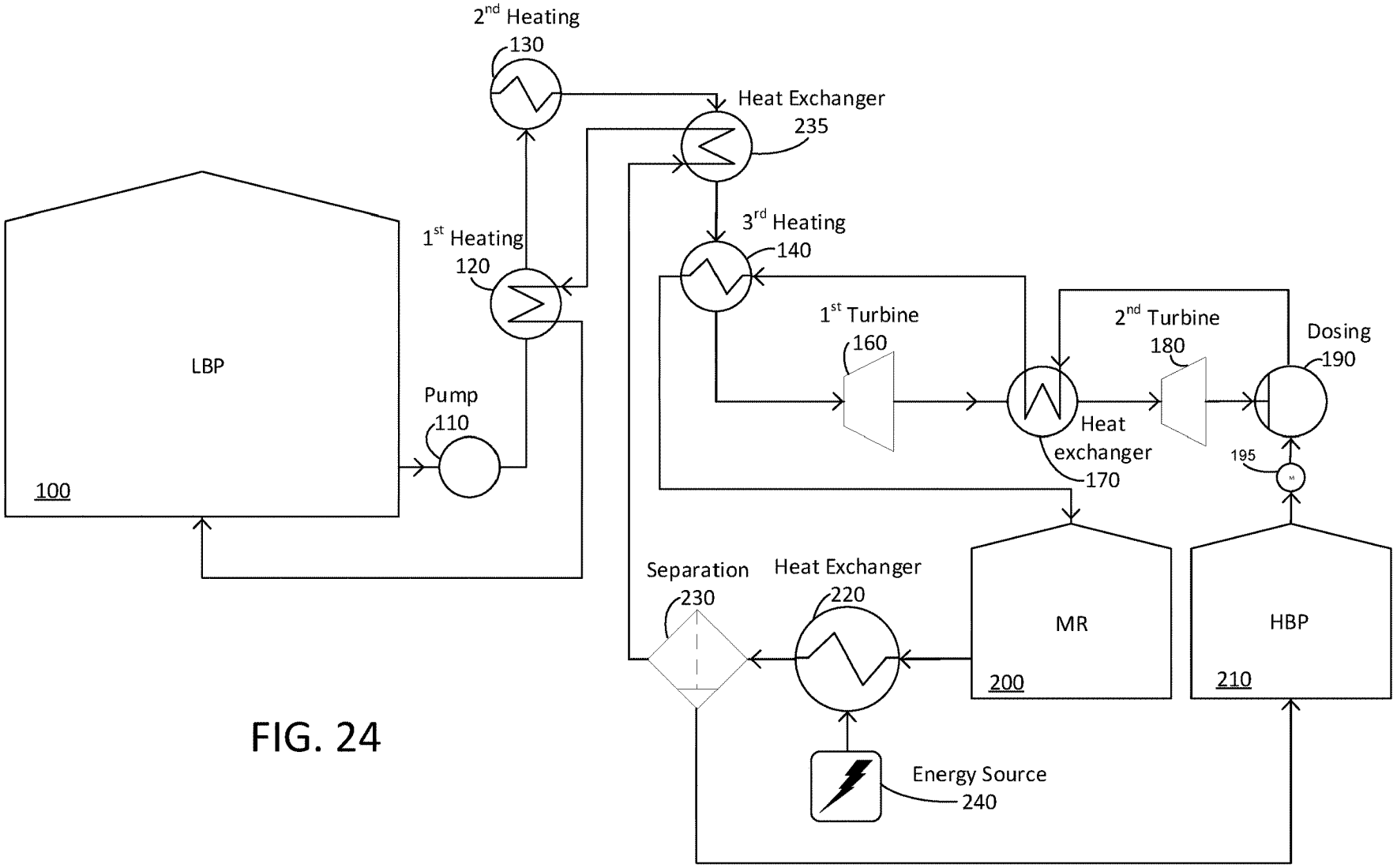
FIG. 24 is a process flow diagram and schematic illustrating a modified Rankine cycle similar to that of FIG. 16 using two turbines with heat absorption in two locations.

FIG. 24 is a process flow diagram and schematic illustrating a modified Rankine cycle similar to that of FIG. 16 using two turbines with heat absorption in two locations. The output of dosing injection port 190 is connected to heat exchanger 170, and then fed to heat exchanger 140, to provide additional heating for the LBP.

Figure 25:
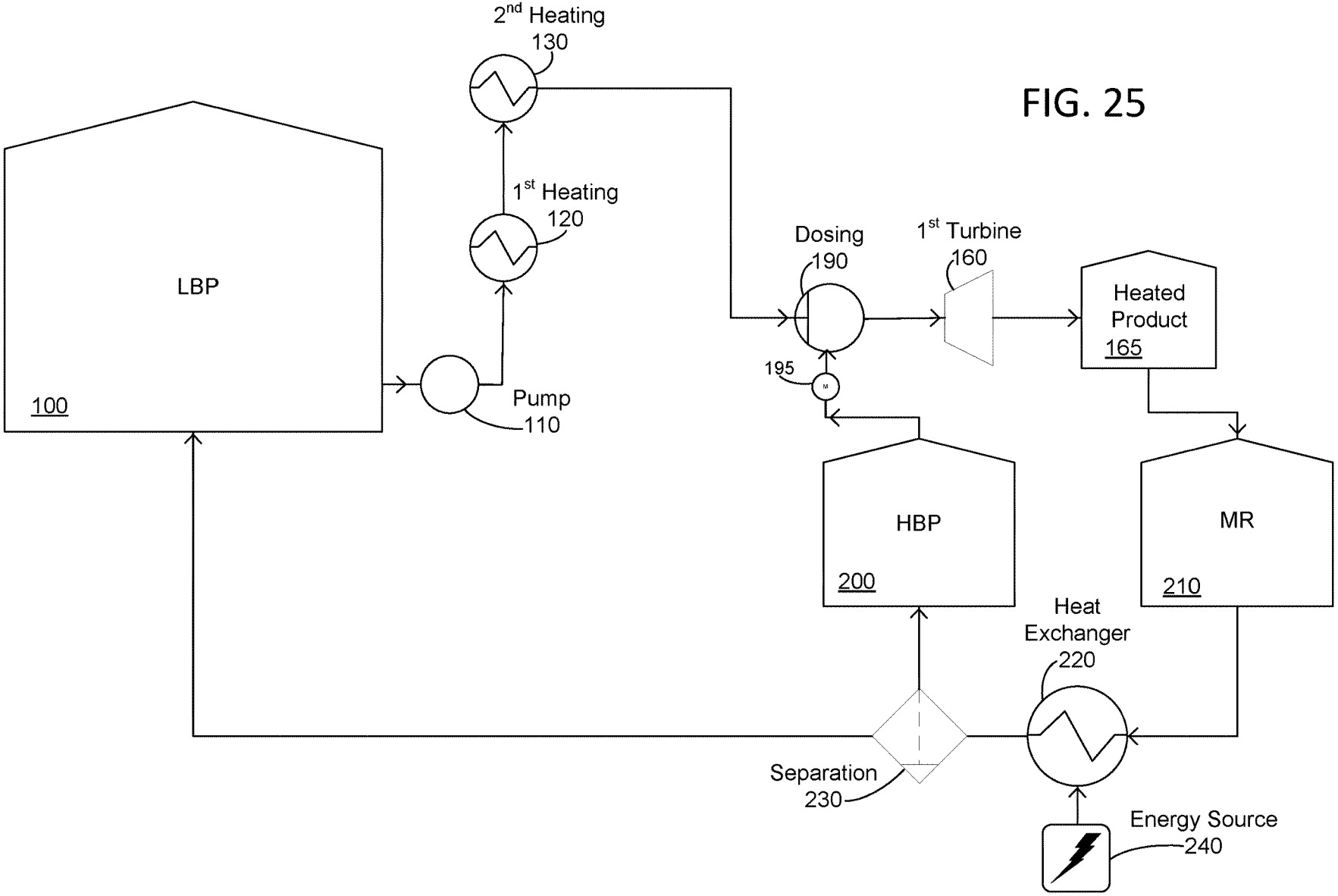
FIG. 25 is a process flow diagram and schematic illustrating a modified Rankine cycle similar to that of FIG. 1 and including thermal-to-thermal energy storage.

FIG. 25 is a process flow diagram and schematic illustrating a modified Rankine cycle similar to that of FIG. 1 and including thermal-to-thermal energy storage. In this embodiment, heat from the modified Rankine cycle is employed to heat an additional process or product shown at storage vessel 165. As shown, controlled dosing of the HBP into the LBP is performed at dosing injection port 190 positioned before the inlet of turbine 160. A heated product storage vessel 165 is added connected to the output of turbine 160 with a heated product in storage vessel 165 in thermal contact with the MR refrigerant for transferring heat. For example, an industrial process may use a heated product such as water or asphalt, which is heated at storage vessel 165. The MR is then fed from an output of storage vessel 165 to MR storage vessel 210.

Figure 26:
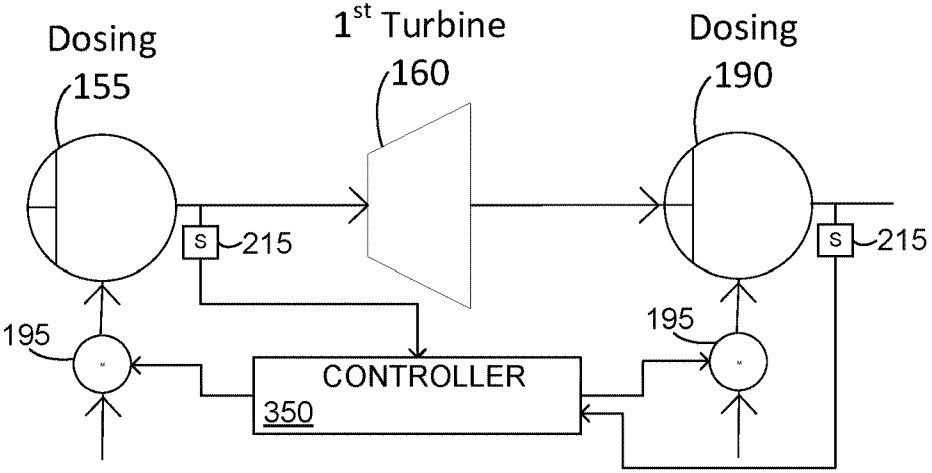
FIG. 26 is a partial process flow diagram and schematic illustrating the use of adjustable dosing in various embodiments.

FIG. 26 is a partial process flow diagram and schematic illustrating the use of adjustable dosing in various embodiments. The depicted arrangement may be used in combination with the features of various embodiments, including the embodiments shown in FIG. 1-FIG. 25. In addition to dosing injection port 190, a dosing injection port 155 is also connected before the inlet of turbine 160. An input to dosing injection port 155 is connected to HBP storage vessel 210 similarly to dosing injection port 190. HBP is dosed through the injection port 155 to increase the temperature or heat content of the resulting MR. One or more sensors 215 are coupled at the output of each dosing injection port 155, 190 to measure temperature and heat content of the MR which may be present as a singular phase liquid or in a mixed liquid and vapor phase. In one implementation, a separator is present after a dosing injection port, and the amount of liquid and gas separated is measured through a Coriolis meter. For example, in one implementation, the liquid's and vapor's total weight and density is being measured allowing both the volume and, by algorithm, the LBP and HBP weight (or mole) content of the liquid and vapor to be determined. Again by operator adjustments or by algorithm the injection rate can be adjusted to increase or decreased to obtain an available temperature or due to higher injection of HBP a higher energy content in the resulting MR. Other suitable sensor arrangements may be used. For example electric resistivity, capacitance, or conductivity of the LBP and HBP liquids (or vapors) can be used to determine the content of the LBP in the HBP and the content of HBP in the LBP upstream of an injection point along with properly located volume meters to calculate the mass (or mole) of the resulting mass flow within the cycle after an injection point with algorithm adjustments made to the injection points control valve to obtain the preferred operating parameters. Temperature and pressure measurements of the LBP and HBP along with the temperature and pressure of the HBP can also be used to determine the with reasonable accuracy the content of each, and by algorithm controlling such dosing. Each sensor 215 is electrically connected to an electronic controller 350, which is typically implemented on a microcontroller board or other computer control system. Controller 350 has an output connected to each dosing control value 195 for adjusting the amount of HBP injected. Generally, controller 350 implements a feedback and/or feedforward control algorithm to maintain a desired mixture of LBP and HBP at the turbine inlet (155), and another desired mixture after the turbine outlet (190), as further described below.

Figure 27:
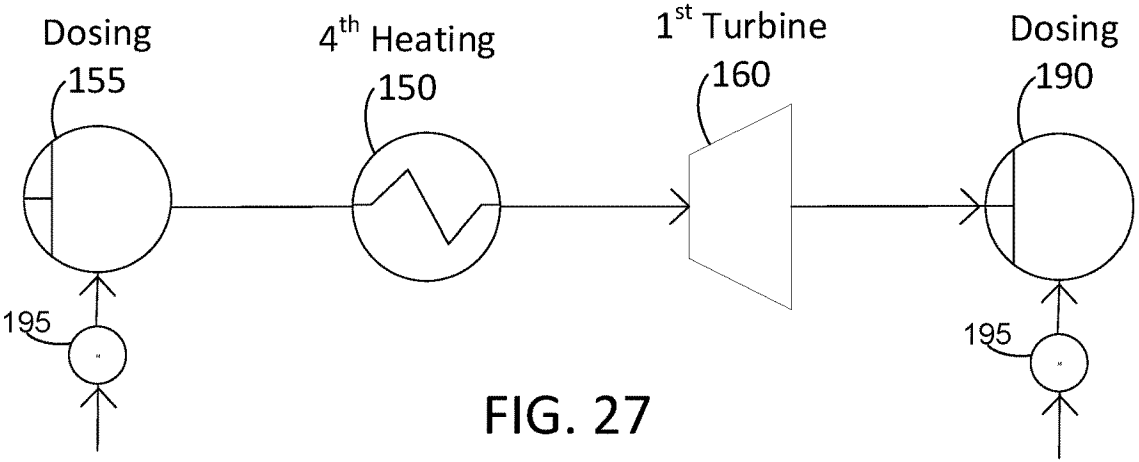
FIG. 27 is another partial process flow diagram and schematic illustrating the use of adjustable dosing in various embodiments.

FIG. 27 is another partial process flow diagram and schematic illustrating the use of adjustable dosing in various embodiments. This arrangement may also be used with the various embodiments herein. Dosing injection port 155 in this embodiment is positioned in advance of heat exchanger 155, the output of which feeds the input of turbine 160.

Figure 28:
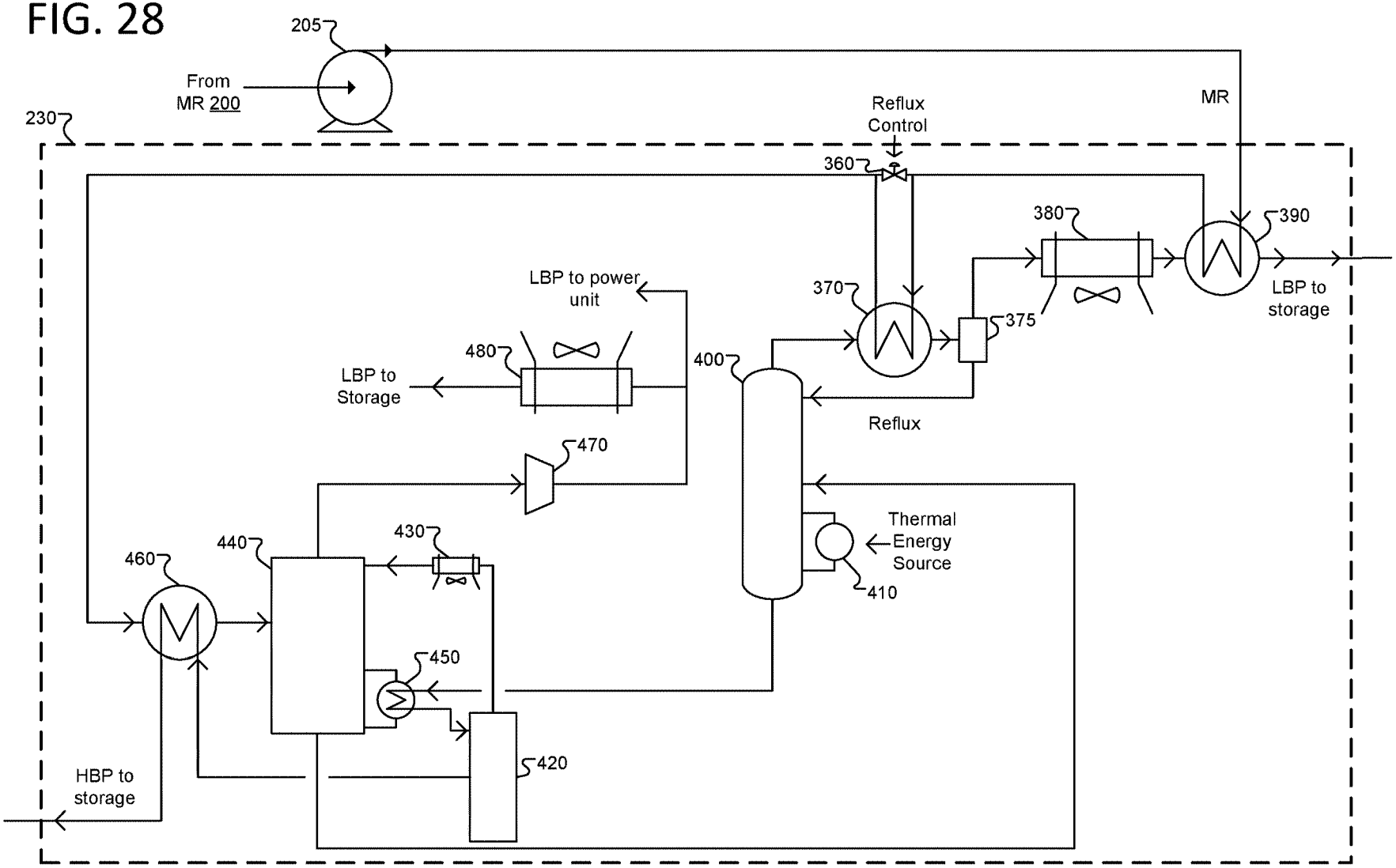
FIG. 28 is a partial process flow diagram and schematic illustrating a separator including reflux according to some embodiments.

FIG. 28 is a partial process flow diagram and schematic illustrating a separator including reflux according to some embodiments. Depicted is an example design of a separator 230 including reflux. While this example is shown, other separators designs may use reflux, and other separators may be used in the various embodiments herein that do not include a reflux in the separation tower. Generally, separator 230 performs the separation or splitting process of the MR to produce the LBP and HBP, and varies a reflux within the splitting process to produce the LBP, the major part of which vaporizes within limits of the temperature and heat content of the initial heating source available concurrent with demand for power.

A pump 205 receives MR from an output of MR storage vessel 200 and pumps it to an input of separator 230. From that input, the MR flows through a heat exchanger 390 and to a reflux control valve 360, which controls the amount of MR directed through a heat exchanger 370 for controlling the reflux step, as further described below, or straight through to a heat exchanger 460. From heat exchanger 460, the MR is fed to an input of a separating vessel 440.

At separating vessel 440, an initial separation is performed with any vaporized LBP leaving separating vessel 440 through an output connected to a compressor 470. The output of compressor 470 is connected to the input of a fin-fan unit 480, or alternately the LBP at this point can be fed back for dosing in advance of the power generating unit (i.e. turbine 160) at 155 (FIG. 26, FIG. 27). In some embodiments, depending on the MR combination used, a compressor may not be needed at 470. For an ammonia water cycle, compressor 470 is used as a booster compressor to boost the pressure of the LBP from approximately 120 psi to above the pressure at input of turbine 160 of approximately 145 psi. Fin-fan unit 480 performs cooling and may also not be necessary in some implementations.

MR leaves separator vessel 440 through an output connected to fractionating column 400. Fractionating column 400 is a distillation tower or distillation column, typically with multiple trays including bubble caps for performing a fractionating process, and has a reboiler supplied with heat from a thermal energy source 410 (such as 240, 220 above) which is the source of outside energy used for the splitting process. The bottoms from the fractioning process at column 400 are fed to the heater 450 of separator vessel 440, and then to a pressure drop vessel 420. HBP from pressure drop vessel 402 is fed to heat exchanger 460 to further cool it while heating the incoming MR, and from there to HBP storage vessel 200. With the pressure drop at vessel 420, there will be boil-off (flashing) of residual LBP, which is passed through a fin-fan unit 430 and fed to an input of separator vessel 440.

From fractionating column 400, LBP vapor is fed from an output to heat exchanger 370, which heats a portion of the input MR as controlled by reflux control valve 360. From there, the LPB is fed to separator 375, where from which liquid LBP is fed back to an input of fractionating column 400. The volume of liquid is measured at exiting separator 375, and this measurement is fed to a control algorithm for controlling the reflux ratio by controlling reflux control valve 360 to achieve a near complete vaporization of the LBP. Vapor from separator 375 is fed to the input of a fin-fan unit 380 for cooling, and then through heat exchanger 390 where it is further cooled while heating the incoming MR. From the output of heat exchanger 390, the LBP is fed to LBP storage vessel 100. The initial boiling point of the LBP, at an expected operating pressure of the let-down turbine, is determined by temperature and pressure at a top of the distillation tower of fractionating column 400.

While this implementation is shown for a separator 230, various other separating processes may be used, depending on the mixed refrigerant employed. For example, a simple distillation tower may be used in some embodiments at the location of fractionating column 400, without reflux. As another example, multiple partial condensation steps may be used without a distillation column.

The following features may be employed in various combinations and sub-combinations in various embodiments of the invention.

1. Mixed refrigerants are used, such as those widely employed in refrigeration systems and other MR systems. Mixing two or more compounds allows for formulation which provide superior service in either thermal efficiencies capital investments or both. Due to the Vapor liquid equilibrium of mixed components, the vapor and liquid phases typically vary in compositions with the lower boiling point component that is more prevalent in the vapor phase and the higher boiling point liquid more prevalent in the liquid phase. At proper temperatures and pressures the lower vapor phase of a mixed refrigerant can be reabsorbed to the liquid phase, but due to a phase change the heat of vaporization/condensation will be manifest with a typical increase in temperature.

Accordingly, the present invention in some embodiments provides a controlled energy efficient system and process that allow for thermal energy to be stored and then converted into electrical or mechanical energy. Through the storage mechanism, and the use of mixed refrigerants which have relatively low temperatures of initial vaporization, the concentrated and stored thermal energy can be converted to power on a schedule or needed basis. This energy storage system to power generation circuit includes:

a. A cold (low pressure) and/or a warm (higher pressure) storage tank or vessel which contains a LBP liquid (100). This LBP liquid could be a nearly pure component of the mixed refrigerant, or the LBP liquid could be a mixture. When vaporized the LBP will be capable of being reabsorbed to a liquid state by the mixing with the HBP (210).

b. A pump (110) which pumps the LBP liquid from storage to a pressure which preferably allows for a significant amount (15% to 100%) of the LBP liquid to be vaporized by a "waste" heat source which in temperate climates may be ambient air.

2. The heating sources of (120, 130, 140, 150) may be waste heat or provided from other sources. Pump 110 forces the liquid LBP through the heating circuit. In the simplest form, only a single heating step may be used between the LBP (100) and the turbine (160), performed by a heat exchanger placed, for example, at the location of 120, 130 of FIG. 1. The LBP heating circuit may include:

a. First heating of the liquid LBP constituent. In some embodiments, as LBP constituent of mixed refrigerants will have low temperature boiling points ranging from as low as −112 C to as high as 130 C. If "waste" heat sources available, providing a low boiling point beneath the expected temperature of the waste heat sources allows for using the waste heat for the initial vaporization heat source, thus providing the bulk of the energy required in the rankine process. The boiling points are listed at pressures achieved at the output of pump 110. In some embodiments, the LBP (depending on the selected mixed refrigerant) may have an initial boiling point of less than −165 C (−324 F). The LBP cold temperature, in such case, be used for any refrigerant liquification, or cold conditioning applications.

b. A second heating, by ambient air, ground circulation or other sources may be used to increase the LBP temperature until the economic returns are met or otherwise practical (120, 130, 140, 150).

c. A third heating by use of a heat exchanger transferring heat from the power circuits turbine exhaust after such exhaust is either/or, both heated and dosed with HBP (170).

3. The temperature adjustment by use of heat exchangers or heaters using thermal energy from the LBP/HBP recovery circuit, full heaters, and/or other heating sources from the heating circuit (120, 130, 140, 150) are utilized for the vaporized and heated LBP as it enters the power circuit:

a. A turbine is used to convert the thermal energy of the vaporized and heated LBP to power (160 & 180). Small units such as solar air conditioning systems may use a screw expander with an induction generator for simple operation. Larger facilities may incorporate a properly controlled axial or radial flow turbines in either single or multi-stages with a synchronous generation for better efficiencies. A larger unit would be more efficient but does require more complex controls.

b. The process provides initial heating of the LBP exhaust leaving the turbine depending upon the mixed refrigerant selected may have an exit temperature above or below 0 degrees Celsius. In such cases the LBP exhausting the turbine should be heated (170) with sources such as used in the first heating, or second heating used within the comprised heating circuit.

c. The process further increases the temperature of the turbine exhaust by controlled dosing (190) of the LBP vapor with the HBP. The actual dosing steps, rates, and the resulting temperatures attained are dependent on the vapor liquid equilibrium of the LBP and HBP fractions and the latent heat of vaporization for the LBP fraction. Dosing is controlled by controlling one of more dosing valves (155, 190) in form of controllable injection valves feeding a nozzle. The dosing before the turbine (155) is used to optimize the temperature of the LBP entering the turbine, and the dosing after the turbine (190) is used to condense the LBP back to a MR liquid by adding the HBP. An electronic controller operates preferably by measuring the results of dosing and adjusting the injection mixture at each dosing step (155, 190). In one implementation, a separator is present after each dosing valve, and the amount of liquid and gas separated is measured. In one implementation, the liquid is measured by weight. Based on this measurement, an electronic controller sets the injection valve to control the amount of HBP injected. Generally, to control the pre-turbine dosing step, it is desirable to inject only enough HBP so that the LBP starts to condense, for example achieving 2-3% condensed LBP at the pre-turbine dosing step (155), in order to optimize the efficiency of extracting energy from the LBP with the turbine. The liquid separated is MR in various compositions. This step may use a lookup table (LUT) with a desired profile of valve settings optimized for the target application. Any suitable control algorithm may also be used. In another implementation, temperature is measured before and after each dosing step (155, 190), and a similar control process is implemented by an electronic controller to control the amount of HBP injected by the dosing valve(s). A pressure measurement may instead be used in some implementations. The dosing step (190) seeks to condense all of the LBP exiting the turbine most efficiently by controlling the amount of HBP injected.

d. An example of reverse-cascading ("up-scading") as shown in FIG. 6 uses a heat exchanger (165) thermally coupled at the output of turbine (160), using the higher temperature at the turbine exit to heat lower temperature LBP. The vapor exiting the turbine has heat energy which is employed in this example with an additional Rankine cycle (330, 320, 300, 120) to heat the LBP at heat exchanger (120). The turbine output dosing step (190) therefore serves to both help condense the vapor at the turbine output and indirectly to heat the LBP leaving LBP storage at (100). This process employs what might have been wasted heat to use it as a heating source for the overall cycle. A third cycle may also be added (typically using a different refrigerant) connecting to heat exchanger 320.

e. Cooling the remixed refrigerant by use of a heat exchanger in contact with the third heating of the LBP heating circuit (140).

f. The process includes storing the remixed refrigerant in a battery of low-pressure tanks or vessels. Completing the power circuit by separating the MR to LBP (100) and HBP (210) forms for storage using energy source (240) (which may be intermittent) feeding into heat exchanger (220) and separator (230). The separation process at (220) and (230) may be designed to run continuously or intermittently when power is available, for example from a solar power plant, wind turbines, a power grid which intermittently has excess power (off-peak power) available at a lower cost, or other intermittent energy source. For example, if there is intermittent energy source available 6 hours a day to provide the energy at 240, the separator at 230 is designed with capacity to separate the needed volumes in 6 out of 24 hours. Due to storage of MR, the HBP and LBP separation from MR may be operated inconsistently and therefore is may be operated separated from the turbine(s) power generation. The turbine(s) may be operated while the separator is operated.

4. From the stored mixed refrigerant battery, the LBP recovery circuit may include:
   a. A pump (110) that pumps the mixed refrigerant to a pressure which allows LBP vapor to become condensed at the temperature of available condensing mediums may be ambient air, lower temperature water, the LBP liquid of the first heating within the LBP heating circuit or other sources.
   b. A succession of cascading pressure vessels (170, 180, 185, 300-410) with internal reboilers or heaters
   c. Heat exchangers which condense the LBP vapor
   a. A heating source with enough thermal energy to heat each cascading pressure vessel to a temperature which boils LBP vapor from the mixed refrigerants
   b. A control valve that releases the HBP liquid and instrument that pierces the HBP liquid from each cascading pressure vessel to the next vessel and finally to the mixed refrigerant tank battery.
   c. Blowers which recirculate LBP vapor from each vessel to the upstream vessel when lower temperature separations are necessary.

Further, as described herein, the various features have been provided in the context of various described embodiments, but may be used in other embodiments. The combinations of features described herein should not be interpreted to be limiting, and the features herein may be used in any working combination or sub-combination according to the invention. This description should therefore be interpreted as providing written support, under U.S. patent law and any relevant foreign patent laws, for any working combination or some sub-combination of the features herein.

The above-described embodiments are intended to illustrate the principles of the invention, but not to limit the scope of the invention. Various other embodiments and modifications to these example embodiments may be made by those skilled in the art without departing from the scope of the present invention.

FIGURE KEY

100: Low Boiling Point (LBP)
110: Pump
120: $1^{st}$ Heating Source (refrigeration demands)
130: $2^{nd}$ Heating Source (waste heat recovery system or atmospheric air conditions)
140: $3^{rd}$ Heating Source (use of heat of absorption from dosing)
145: Electric Energy Source
150: $4^{th}$ Heating Source (use of super heater, or supplemental heater, utilizing for example: solar heating, propane fueled heater, electric heater, turbine exhaust)
155: Dosing
160: $1^{st}$ Turbine
165: Heat Exchanger (Upscading Cycle)
170: Heat Exchanger
180: $2^{nd}$ Turbine
185: Heat Exchanger (Upscading Cycle)
190: Dosing injection port
195: Dosing control valve
200: Mixed Refrigerant (MR) Storage
205: Pump
210: High Boiling Point (HBP) Storage
215: Sensor(s)
220: Heat Exchanger
230: Separation
235: Heat Exchanger Cooling
240: Energy Source
251: Thermal Energy
300: #2 Rankine Cycle working fluid (Upscading Cycle)
310: Pump (Upscading)
320: Heat Exchanger (Upscading Cycle)
330: $1^{st}$ Turbine (Upscading Cycle)
350: Controller
360: Reflux Control Valve
370: Heat Exchanger
375: Separator
380: Fin-fan unit
390: Heat Exchanger
400: Fractionating column
410: Reboiler
420: Pressure Drop Vessel
430: Fin-fan Unit
440: Separating Vessel
450: Heat Exchanger
460: Heat Exchanger

The invention claimed is:

1. A method of providing flexibly controlled production of mechanical or electrical power using a mixed refrigerant (MR), comprising:
   splitting the MR into two components and independently storing a low-boiling point fluid (LBP) and a high-boiling point fluid (HBP);
   using an initial heating source to fully or partially vaporize the LBP to a gas state;
   feeding the LBP in the gas state to a let-down turbine to generate mechanical or electrical power; and
   adjustably dosing the HBP to at least partially condense the LBP gas upon exit from the let-down turbine to a liquid or two phase state MR, and storing the MR in a storage vessel, and then performing the splitting again.

2. The method of claim 1 wherein the LBP is pumped to a needed operating pressure for allowing vaporization of an acceptable mass component of the LBP before the vaporized LBP flows through the let-down turbine.

3. The method of claim 1 wherein the LBP is used for improving efficiency of generating mechanical or electrical power, splitting the MR, or condensing other fluids in an up-scading power system.

4. The method of claim 1 wherein an acceptable mass of the LBP is at least partially vaporized with the initial heating source using as necessary atmospheric air, a geothermal heating loop, or by any other available energy source.

5. The method of claim 4 wherein the splitting at a separator such that the LBP will vaporize at temperatures of the initial heating source which may vary by seasons, time of day, or weather conditions, the method further comprising:

varying temperature or pressure of the splitting process to produce the LBP with an initial boiling point temperature below an expected temperature of the initial heating source; and varying a reflux within the splitting process to produce the LBP, the major part of which vaporizes within limits of the temperature and heat content of the initial heating source available concurrent with demand for power.

6. The method of claim 1 wherein fully or partially vaporized LBP from the initial heating source is further heated by thermal contact with the MR constituted from absorption of the LBP with the HBP.

7. The method of claim 1 wherein fully or partially vaporized LBP from the initial heating source is dosed using controlled dosing of the HBP prior to the let-down turbine to increase efficiency of the let-down turbine.

8. The method of claim 7 wherein the vaporized LBP is in thermal contact with the MR by use of an absorption column incorporating one of:

a super heater or supplemental heater to further heat the LBP exiting the absorption column; and a MR to LBP heat exchanger with a small portion of the MR used to dose the LBP before thermal coupling of the MR and LPB across the heat exchanger.

9. The method of claim 1 wherein:

splitting the MR is performed using a separate heating source providing energy needed to split the MR into LBP and HBP components;

an initial boiling point of the LBP, at an expected operating pressure of the let-down turbine, is determined by temperature and pressure at a top of a distillation tower;

a near complete vaporization temperature of the LBP is determined by a reflux ratio of the distillation tower; and the initial boiling point of the HBP is determined by a temperature and pressure at a bottom of the distillation tower.

10. The method of claim 1 wherein adjustably dosing the HBP includes adjusting an amount of HBP used to condense the LBP gas to accompany one of:

an adjustment in an amount of heat in the splitting process to produce acceptable HBP and LBP fractions;

a change in temperature or quantity of heat available from an external heating source; or a change in demand for generating the mechanical or electrical power.

11. The method of claim 10 further comprising:

measuring a characteristic of an outlet of the let-down turbine and controlling a dosing valve based on the measured characteristic.

12. The method of claim 1 further comprising:

increasing a temperature of a cool LBP vapor discharged from the let-down turbine to increase temperature and energy content of MR used in heating the LBP vapor before entering the let-down turbine:

progressive managed dosing of the LBP vapor discharged from the let-down turbine with HBP to initially partially condense the LBP to MR, separating the MR at higher temperatures (and lower content of HBP) and pumping the initially partially condensed MR to contact with the LBP before an inlet of the let-down turbine; and adjusting as necessary a dosing rate of the managed dosing to improve the heat recovered and resulting power generation based upon changing temperatures of the heating sources.

13. The method of claim 12 wherein HBP is used to condense the remaining turbine discharge LBP vapor to a liquid state or mostly liquid state.

14. A system for storing energy from one or more energy sources and extracting the stored energy, comprising:

an mixed refrigerant (MR) storage vessel, a low-boiling point fluid (LBP) storage vessel, and an high-boiling point fluid (HBP) storage vessel;

a pump coupled to an output of the LBP storage vessel for increasing pressure of a stored LBP;

a first heat exchanger coupled to an output of the pump output for adding heat energy to the LBP;

a let-down turbine coupled to an output of the heat exchanger for extracting energy from the LBP;

a dosing valve coupled to an outlet of the let-down turbine for controlling condensation of the LBP by controlled injection of HBP to form MR stored in the MR storage vessel;

a second heat exchanger coupled to a MR storage vessel output for adding energy to the MR from an external energy source; and a separator having an input coupled to an output of the MR storage vessel and two outputs coupled to the LBP storage vessel and the HBP storage vessel, respectively, for separating the MR into LBP and HBP.

15. The system of claim 14 further comprising at least one sensor for measuring a characteristic of the let-down turbine outlet and an electronic controller coupled to the sensor for controlling the dosing valve based on the measured characteristic.

16. The system of claim 14 further comprising a second dosing valve coupled before an input of the turbine for controllably adding heat to the LBP by injecting HBP in a controlled fashion.

17. The system of claim 16 further comprising at least one sensor for measuring at least one characteristic related to the turbine input, wherein the second dosing valve is controlled based on the at least one characteristic.

18. The system of claim 14 further comprising a generator mechanically coupled to the turbine for creating electrical energy from rotation of the turbine.

19. The system of claim 14 further comprising a third heat exchanger for coupling heat to the LBP from a second heat source following the first heat exchanger.

20. The system of claim 14 wherein the second heat exchanger is adapted to be operated intermittently based on availability of energy from the external energy source.

* * * * *